US006761154B2

(12) United States Patent
Takagi et al.

(10) Patent No.: US 6,761,154 B2
(45) Date of Patent: Jul. 13, 2004

(54) EVAPORATIVE FUEL PROCESSING APPARATUS AND CONTROL METHOD OF SAME

(75) Inventors: Naoya Takagi, Suntou-gun (JP); Yoshihiko Hyodo, Gotemba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/446,820

(22) Filed: May 29, 2003

(65) Prior Publication Data

US 2003/0226549 A1 Dec. 11, 2003

(30) Foreign Application Priority Data

Jun. 7, 2002 (JP) ..... 2002-167749

(51) Int. Cl.[7] ..... F02M 33/02
(52) U.S. Cl. ..... 123/520; 123/198 D
(58) Field of Search ..... 123/520, 519, 123/518, 198 D; 73/118.1

(56) References Cited

U.S. PATENT DOCUMENTS 5,592,923 A * 1/1997 Machida ..... 123/520
5,794,599 A * 8/1998 Blumenstock
5,845,625 A * 12/1998 Kidokoro et al.
6,223,732 B1 * 5/2001 Isobe et al. ..... 123/520

FOREIGN PATENT DOCUMENTS

JP A 7-91330 * 4/1995

* cited by examiner

*Primary Examiner*—Bibhu Mohanty
(74) *Attorney, Agent, or Firm*—Oliff & Berridge, PLC

(57) ABSTRACT

In an evaporative fuel processing apparatus, a fuel tank and a canister communicate with each other through a vapor passage, and an intake passage of an internal combustion engine and the canister communicates with each other through a purge passage. The evaporative fuel processing apparatus includes an open/close valve which opens or closes the vapor passage, a switching valve which makes the canister open to the atmosphere or isolates the canister from the atmosphere, a booster pump capable of applying pressure to the canister while the switching valve isolates the canister from the atmosphere, a purge control valve which opens or closes the purge passage, and an ECU which controls the open/close valve, the switching valve, the booster pump and the purge control valve.

20 Claims, 13 Drawing Sheets

| VEHICLE STATE | VALVE STATE |
|---|---|
| RUNNING | OPEN |
| PARKED | CLOSED |
| FUELING | OPEN |
| LEAKAGE DETECTION | CLOSED→OPEN |

EVAPORATIVE FUEL PROCESSING APPARATUS AND CONTROL METHOD OF SAME

INCORPORATION BY REFERENCE

The disclosure of Japanese patent application no.2002-167749 filed on Jun. 7, 2002 including the specification, drawings and abstract is incorporated herein by reference in its entirety.

BACKGROUND OF THE INVENTION

1. Field of the Invention

The invention relates to an evaporative fuel processing apparatus. More particularly, the invention relates to an evaporative fuel processing apparatus suitable for processing evaporative fuel generated in an internal combustion engine without releasing the evaporative fuel into the atmosphere, and a control method of the same.

2. Description of the Related Art

As art related to the invention, for example, as disclosed in Japanese Patent Laid-Open Publication No. 7-91330, an evaporative fuel processing apparatus is known in which evaporative fuel generated in a fuel tank is stored in a canister so as to be processed. The evaporative fuel processing apparatus is for preventing the evaporative fuel from being released into the atmosphere. Accordingly, the evaporative fuel processing apparatus needs to have a function of promptly detecting leakage which has occurred therein.

The apparatus according to the related art has a function of applying pressure to a system including the fuel tank and the canister using a booster pump after closing the system. There is a difference in changes in pressure in the system after the application of pressure between when leakage has occurred in the system, and when leakage has not occurred in the system. Accordingly, the apparatus determines the presence or absence of leakage based on a change in the pressure in the system after the application of pressure.

When leakage has occurred in the evaporative fuel processing apparatus, it is preferable that the location of leakage can be determined. However, the apparatus cannot determine the location of leakage in the system including the fuel tank and the canister.

Also, in the evaporative fuel processing apparatus, it is necessary to isolate the fuel tank from the atmosphere in order to prevent the evaporative fuel that is generated while an internal combustion engine is stopped from being released into the atmosphere. According to the apparatus, it is possible to satisfy this requirement by maintaining the entire system including the fuel tank and the canister in a closed state.

However, an internal pressure in the system may become high due to generation of the evaporative fuel. Accordingly, it is necessary to make the structure of the entire system including the fuel tank and the canister pressure-resistant in order to close the system so as to prevent the evaporative fuel from being released into the atmosphere. Therefore, it is difficult to realize the apparatus at a low cost and in a light weight.

SUMMARY OF THE INVENTION

The invention is made in order to solve the above-mentioned problem. Accordingly, it is an object of the invention to provide an evaporative fuel processing apparatus and control method of the same, in which a state where a fuel tank and a canister are isolated from each other can be realized.

An evaporative fuel processing apparatus according to a first aspect of the invention includes a fuel tank; a canister which communicates with the fuel tank through a vapor passage; a purge passage which permits communication between an intake passage of an internal combustion engine and the canister; an open/close valve which opens or closes the vapor passage; an isolated state switching mechanism which makes the canister open to the atmosphere or which isolates the canister from the atmosphere; a pressure adjusting mechanism which increases or reduces the pressure in the canister; a purge control valve which opens or closes the purge passage; and a control system which controls the open/close valve, the isolated state switching mechanism, the pressure adjusting mechanism and the purge control valve.

According to the first aspect of the invention, in addition to the fact that it is possible to realize the basic functions (storage/purge of the evaporative fuel, and a leakage diagnosis) as the evaporative fuel processing apparatus, it is possible to allow the canister and the fuel tank to form a single space or separate spaces by opening or closing the open/close valve.

In a second aspect of the invention, the control system according to the first aspect may further closes a canister space which includes the canister and which does not include the fuel tank by closing the open/close valve, isolating the canister from the atmosphere using the isolated state switching mechanism, and closing the purge control valve, adjusts an internal pressure in the closed canister space using the pressure adjusting mechanism, and performs a diagnosis on leakage (hereinafter, referred to as a "leakage diagnosis") in the canister space based on the adjusted internal pressure in the canister space.

According to the second aspect of the invention, it is possible to perform a leakage diagnosis for the canister space while the fuel tank is isolated from the canister. Therefore, it is possible to detect leakage only for the canister space.

In a third aspect of the invention, the control system according to the second aspect may further prohibits the opening of the open/close valve when it is determined that leakage has occurred in the canister space.

According to the third aspect of the invention, when there is leakage in the canister space, it is possible to prohibit the opening of the open/close valve and prevent leakage of the evaporative fuel from the leakage portion.

In a fourth aspect, the control system according to either the second or third aspect may further closes an entire space including the canister and the fuel tank as a single space by opening the open/close valve, isolating the canister from the atmosphere using the isolated state switching mechanism, and closing the purge control valve when it is determined that leakage has not occurred in the canister space, adjusts the internal pressure in the closed entire space using the pressure adjusting mechanism, and performs a leakage diagnosis for the entire space based on the adjusted internal pressure in the entire space.

According to the fourth aspect of the invention, when it is determined that there is no leakage in the canister space, it is possible to determine whether there is leakage in the entire space including the fuel tank. In this case, when there is leakage on the fuel tank side, it is possible to detect leakage as an abnormality on the fuel tank side.

In a fifth aspect of the invention, the control system according to the second aspect may further close an entire space including the canister and the fuel tank as a single space by opening the open/close valve, isolating the canister from the atmosphere using the isolated state switching mechanism, and closing the purge control valve after the completion of the leakage diagnosis for the canister space, adjusts the internal pressure in the closed entire space using the pressure adjusting mechanism, performs a leakage diagnosis for the entire space based on the adjusted internal pressure in the entire space.

According to the fifth aspect of the invention, it is possible to determine whether leakage has occurred in the entire space including the fuel tank regardless of whether leakage has occurred in the canister space. According to the results of the two diagnoses performed in the fifth aspect of the invention, it is possible to detect leakage in the apparatus and specify the location of the leakage.

BRIEF DESCRIPTION OF THE DRAWINGS

FIG. 3A shows a state of an open/close valve 20, FIG. 3B shows a state of a switching valve 36, FIG. 3C shows a state of a booster pump 40, and FIG. 3D shows a change (a dashed line) in a tank side pressure Pt detected by a tank side pressure sensor 12, and a change (a solid line) in a pump side pressure Pp detected by a pump side pressure sensor 48;

DETAILED DESCRIPTION OF THE PREFERRED EMBODIMENTS

Figure 1:
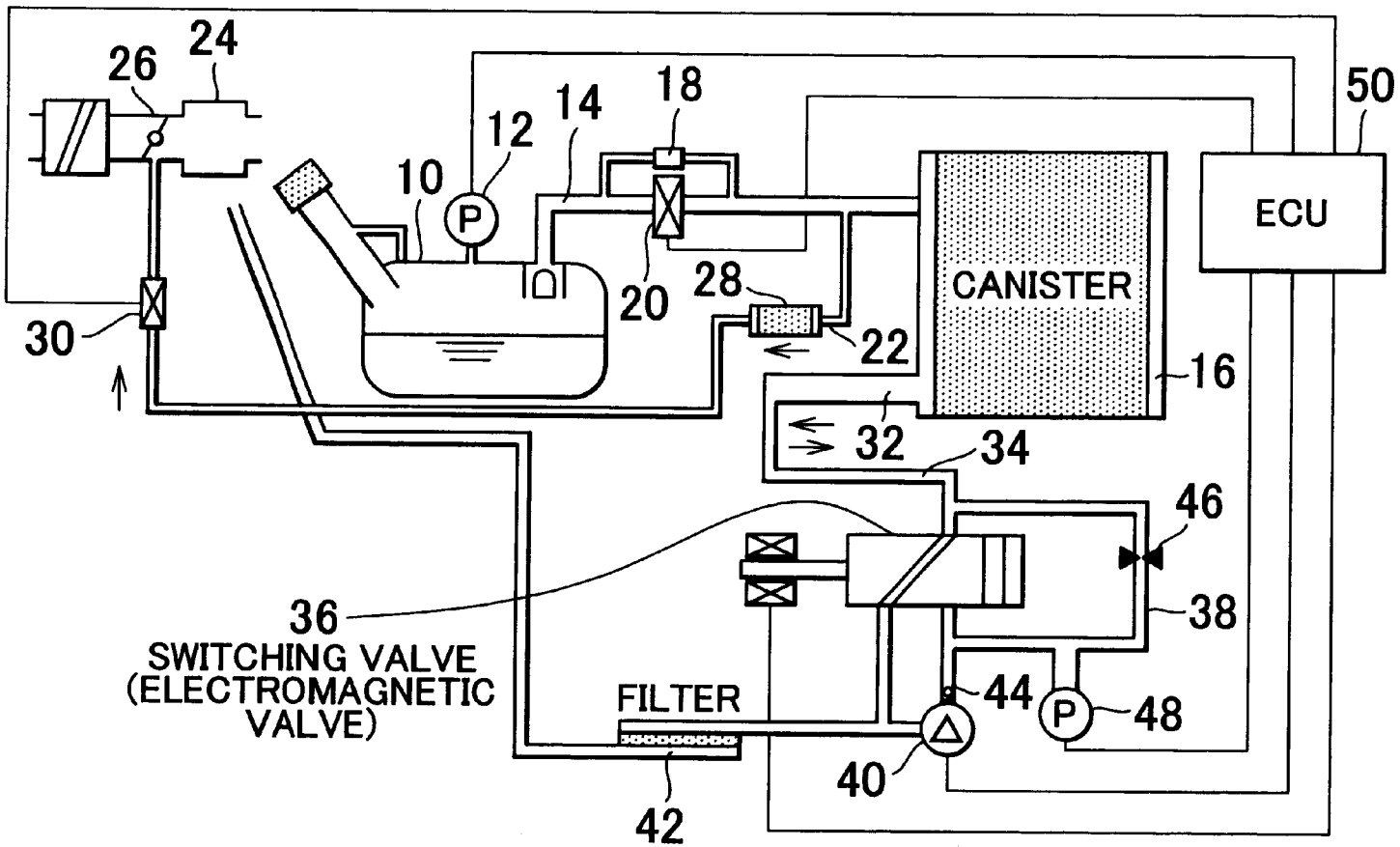
FIG. 1 is a diagram describing a configuration of an evaporative fuel processing apparatus according to a first embodiment.

Hereafter, embodiments according to the invention will be described with reference to accompanying drawings. Note that the same reference numerals will be assigned to elements common to each of the drawings and overlapping description will be omitted.

FIG. 1 is a diagram for describing a configuration of an evaporative fuel processing apparatus according to a first embodiment of the invention. A system shown in FIG. 1 includes a fuel tank 10. A tank side pressure sensor 12 for measuring an internal pressure in the fuel tank 10 is attached to the fuel tank 10. Hereinafter, a pressure detected by the tank side pressure sensor 12 will be referred to as a "tank side pressure Pt".

The fuel tank 10 communicates with a canister 16 through a vapor passage 14. A mechanical positive/negative pressure valve 18 and an electromagnetic open/close valve 20 are provided in parallel in the vapor passage 14. The positive/negative pressure valve 18 is a bidirectional relief valve which opens when a differential pressure equal to or higher than an opening pressure is generated between both sides thereof. The open/close valve 20 is an electromagnetic valve which opens or closes according to a driving signal supplied from the outside.

A purge passage 22 communicates with the canister 16 as well as the vapor passage 14. The purge passage 22 communicates with an intake passage 24 of an internal combustion engine. More particularly, the purge passage 22 communicates with the intake passage 24 on a downstream side of a throttle valve 26, where an intake negative pressure is generated. A buffer layer 28 and a purge control valve 30 are embedded in the purge passage 22. The buffer layer 28 is a unit in which activated carbon is filled, and is provided so as to prevent a drastic change of the fuel concentration in the purge gas flowing through the purge passage 22. The purge control valve 30 is a control valve for realizing an opening according to a driving signal which is actually supplied from the outside, and is provided so as to control a flow amount of the purge gas purged to the intake passage 24.

The canister 16 includes an atmosphere introducing hole 32. A new atmosphere introducing hole 34 communicates with the atmosphere introducing hole 32. The new atmosphere introducing passage 34 is a passage whose end portion is open to the atmosphere, and includes a switching valve 36, a bypass passage 38, a booster pump 40 and a filter 42.

The booster pump 40 takes in the air which has passed through the filter 42 and discharges the air from a discharging opening. A check valve 44 which permits only the discharge of the air by the booster pump 40 is provided in the discharging opening of the booster pump 40. The bypass passage 38 bypasses the switching valve 36, and allows the atmosphere introducing hole 32 of the canister 16 and the discharging opening of the booster pump 40 to communicate with each other at all times. A reference orifice 46 of 0.5 mm in diameter and a pump side pressure sensor 48 are provided in the bypass 38. Hereinafter, a pressure detected by the pump side pressure sensor 48 will be referred to as a "pump side pressure Pp".

The switching valve 36 selectively realizes a state (atmospheric state) in which the canister 16 directly communicates with the filter 42, and a state (pressurized state) in which the canister 16 communicates with the discharging opening of the booster pump 40 without passing through the bypass passage 38. According to a system in the embodiment, it is possible to make the canister 16 open to the atmosphere and to introduce the atmospheric pressure to the space whose pressure is detected by the pump side pressure sensor 48, by controlling the switching valve 36 to be at the atmospheric state realizing position. Meanwhile, it is possible to isolate the canister from the atmosphere and to introduce the discharge pressure of the booster pump 40 to the canister 16 and the space whose pressure is detected by the pump side pressure sensor 48, by controlling the switching valve 36 to be at the pressurized state realizing position.

As shown in FIG. 1, the evaporative fuel processing apparatus according to the embodiment includes an ECU (Electronic Control Unit) 50. The ECU 50 is a control unit of the evaporative fuel processing apparatus. The outputs from the tank side pressure sensor 12 and the pump side pressure sensor 48 are supplied to the ECU 50. Also, the open/close valve 20, the purge control valve 30, the switching valve 36 and the booster pump 40 are controlled by the ECU 50.

Figures 2, 3A, 3B, 3C, 3D:
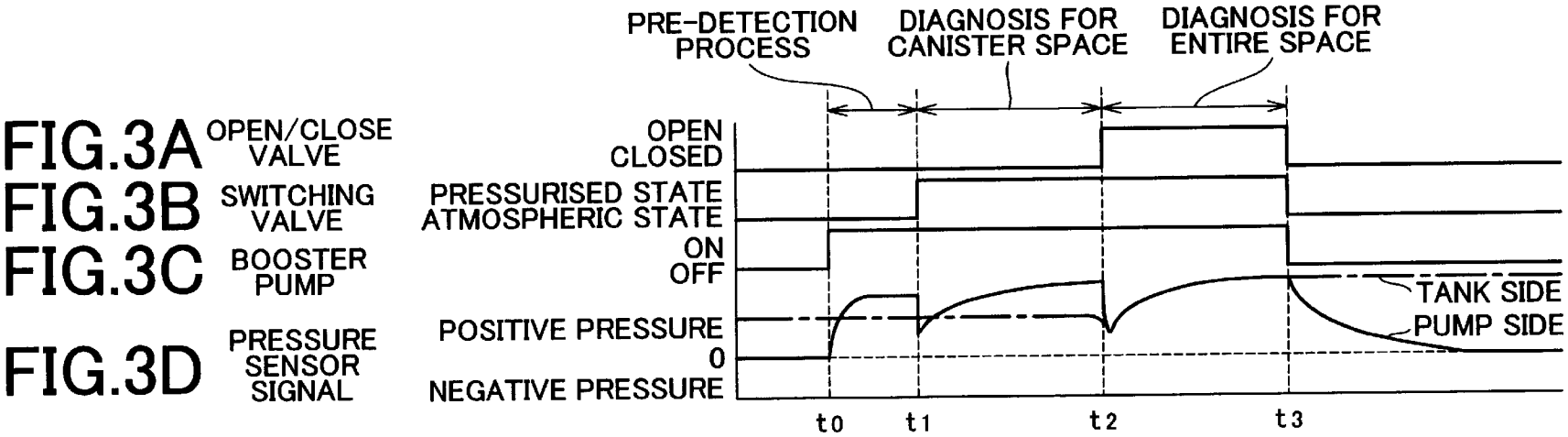
FIG. 2 is a diagram for describing operation of an open/close valve included in the apparatus according to the first embodiment.
FIGS. 3A to 3D are a timing chart for describing details on a leakage diagnosis performed by the apparatus according to the first embodiment.

Next, operation of the evaporative fuel processing apparatus according to the embodiment will be described. FIG. 2 is a diagram describing states of the open/close valve 20 included in the evaporative fuel processing apparatus depending on the states of a vehicle. As shown in FIG. 2, the open/close valve 20 is kept open while the vehicle is running (during the operation of the internal combustion engine). When the open/close valve 20 is kept open, the fuel tank 10 and the canister 16 communicates with each other. In this case, the evaporative fuel generated in the fuel tank 10 can flow into the canister 16 and the purge passage 22.

The ECU 50 controls the switching valve 36 to be at the atmospheric state (the state shown in FIG. 1) realizing position in principle while the vehicle is running. In this case, the canister 16 is open to the atmosphere. While the vehicle is running (during the operation of the internal combustion engine), an intake negative pressure is generated in the intake passage 24. Accordingly, the purge control valve 30 is opened while the vehicle is running, and the intake passage 24 communicates with the canister 16 through the purge passage 22. Consequently, the intake negative pressure is introduced to the canister 16. As a result, air flows into the canister 16 from the atmosphere introducing hole 32, and the fuel stored in the canister 16 is removed due to the flow of air. Then, the purge gas containing fuel is purged to the intake passage 24 through the purge passage 22.

In this case, when the evaporative fuel has been generated in the fuel tank 10, the evaporative fuel in the fuel tank 10 is mixed with the purge gas and is taken in the intake passage 24 to a degree at which the tank side pressure Pt is balanced with the internal pressure in the canister. Therefore, according to the evaporative fuel processing apparatus in the embodiment, it is possible to purge the fuel stored in the canister 16, and the evaporative fuel generated in the fuel tank 10 to the intake passage 24 by opening the purge control valve 30 while the vehicle is running.

As shown in FIG. 2, the open/close valve 20 is kept open even during fueling. Namely, according to the apparatus in the invention, the open/close valve 20 is kept open during fueling even while the internal combustion engine is stopped. During fueling, it is necessary to permit discharge of a large amount of the evaporative fuel from the fuel tank 10 such that a large empty capacity in the fuel tank 10 is smoothly replaced by the fuel. According to the apparatus in the embodiment, it is possible to efficiently capture the evaporative fuel which is discharged during fueling using the canister 16.

As shown in FIG. 2, the open/close valve 20 is kept closed while the vehicle is parked (while the internal combustion engine is stopped) except for the leakage detection time, to be described later. The evaporative fuel is generated in the fuel tank 10 due to remaining heat of the internal combustion engine and the like even while the vehicle is parked. Accordingly, when the fuel tank 10 is open to the atmosphere while the vehicle is parked, the evaporative fuel may be released into the atmosphere.

It is possible to prevent such release of the fuel into the atmosphere by isolating the canister 16 from the atmosphere while keeping the open/close valve 20 open. However, in this case, an increase in the internal pressure due to the generation of the evaporative fuel occurs in the canister 16 as well. Accordingly, in this case, it is necessary to make the structure of the canister 16 and the purge passage 22 pressure-resistant as well as the fuel tank 16.

Meanwhile, in the apparatus according to the embodiment, since the open/close valve 20 is kept closed in principle while the vehicle is parked, it is possible to allow an increase in the pressure due to the generation of the evaporative fuel to occur only in the fuel tank 20. In this case, since it is not necessary to make the structure of the canister 16 and the purge passage 22 pressure-resistant, it is possible to realize the apparatus according to the embodiment at low cost and in a light weight. Thus, according to the embodiment, the evaporative fuel generated while the internal combustion engine is stopped can be prevented from leaking into the atmosphere, by making only the purge gas concentration which accurately indicates the fuel storage state of the canister.

The evaporative fuel processing apparatus according to the embodiment performs a leakage diagnosis for detecting leakage in the system at predetermined timing while the vehicle is parked. It is possible to perform a leakage diagnosis not only while the vehicle is parked but also while the vehicle is running. However, while the vehicle is running, an external cause such as swinging of a fluid level in the fuel tank 10 due to running vibration and a change in the temperature of the fuel tank 10 is generated, which has a negative effect on the accuracy of the leakage diagnosis. According to the apparatus in the embodiment, since a leakage diagnosis is performed while the vehicle is parked, it is possible to avoid the negative effect of such an external cause, and consequently, it is possible to enhance the accuracy of the leakage diagnosis.

As shown in FIG. 2, the open/close valve 20 which has been closed is opened during the leakage diagnosis. Since a leakage diagnosis is performed while the vehicle is parked, after the completion of the diagnosis process, the open/close valve 20 is closed again according to the basic control. Hereafter, the details on the process of the leakage diagnosis will be explained in detail with reference to FIG. 3 and FIG. 4.

FIGS. 3A to 3D are a timing chart describing the operation of the apparatus during the leakage diagnosis. More particularly, FIG. 3A shows the state of the open/close valve 20, FIG. 3B shows the state of the switching valve 36, and FIG. 3C shows the state of the booster pump 40. FIG. 3D shows a change (a dashed line) in the tank side pressure Pt detected by the tank side pressure sensor 12, and a change (a solid line) in the pump side pressure Pp detected by the pump side pressure sensor 48. The purge control valve 30 is kept closed at all times while the vehicle is parked and a leakage diagnosis is performed. Accordingly, the state of the purge control valve 30 is not shown in the diagram.

In the examples shown in FIGS. 3A to 3D, pre-detection process is started at time t0. As shown in FIG. 3A, the open/close valve 20 is closed before time t0 (the fuel tank 10 is closed). Accordingly, as shown by the dashed line in FIG. 3D, the tank side pressure Pt becomes a positive pressure at time t0. Before time t0, the switching valve 36 is at the atmospheric state realizing position, as shown in FIG. 3B. Accordingly, the pump side pressure Pp is kept at the atmospheric pressure at time t0, as shown by the solid line in FIG. 3D.

At time t0, which is a start time of the pre-detection process, the booster pump 40 is turned ON, as shown in FIG. 3C. Since the switching valve 36 is kept at the atmospheric state realizing position at this time, the air discharged from the booster pump 40 is released into the atmosphere through the reference orifice 46 of 0.5 mm in diameter. In this case, the pump side pressure Pp is the same pressure as in the case where there is a hole of 0.5 mm in diameter in the apparatus (refer to FIG. 3D). In the embodiment, the ECU 50 stores this final pressure as a reference value Pth for the leakage diagnosis. According to such a method, it is possible to accurately set the reference value Pth for determining the presence or absence of leakage portion of substantially 0.5 mm in diameter.

The pre-detection process is performed only for a length of time which is necessary for the pump side pressure Pp to reach the above-mentioned pressure. In the example shown in FIGS. 3A to 3D, the pre-detection process is performed until time t1, and then a leakage diagnosis for the canister space is started. The "canister space" in this case corresponds to a space which is partitioned by the open/close valve 20, the purge control valve 30, the booster pump 40 (the check valve 44), that is, a space which includes the canister 16 and does not include the fuel tank 10.

At time t1, which is the start time of the leakage diagnosis for the canister space, the switching valve 36 is controlled to be at the pressurized state realizing position, as shown in FIG. 3B. As a result, the passage through which the air discharged from the booster pump 40 is released into the atmosphere is interrupted, and the canister space starts being pressurized by the discharge pressure. Consequently, the output from the pump side pressure sensor 48, that is, the pump sire pressure Pp temporarily decreases, and becomes the pressure corresponding to the state of the leakage in the canister space (refer to FIG. 3D).

The final value of the pump side pressure Pp during the leakage diagnosis for the canister space is equal to or lower than the reference value Pth which is set in the pre-detection process, when leakage portion of equal to or larger than substantially 0.5 mm in diameter has been formed in the canister space. Meanwhile, when such leakage has not occurred, the final value is larger than the reference value Pth. Accordingly, the ECU 50 waits until the pump side pressure Pp reaches the final value and determines whether leakage has occurred in the canister space by comparing the final value with the reference value Pth.

In the example shown in FIGS. 3A to 3D, a leakage diagnosis for the canister space is performed until time t2, and then a leakage diagnosis for the entire space is started. In this case, the "entire space" is referred to as a space formed by adding the fuel tank 10 to the above-mentioned canister space. In the embodiment, a leakage diagnosis for the entire space is performed only when leakage has not been detected in the canister space. Accordingly, a leakage diagnosis for the entire space substantially corresponds to a leakage diagnosis for the fuel tank 10.

At time t2, which is the start time of the leakage diagnosis for the entire space, the open/close valve 20 is opened, as shown in FIG. 3A. When the open/close valve 20 is opened, since the fuel tank 10 and the canister 16 form a single space, the tank side pressure Pt becomes equal to the pump side pressure Pp. Then, the tank side pressure Pt temporarily decreases, and becomes the pressure corresponding to the state of the leakage in the entire space by being supplied with the air discharged from the booster pump 40, (refer to FIG. 3D).

The tank side pressure Pt during the leakage diagnosis for the entire space becomes a value equal to or lower than the reference value set in the pre-detection process when the leakage portion of equal to or larger than substantially 0.5 mm in diameter has been formed in the entire space. Meanwhile, when such leakage has not occurred in the entire space, the tank side pressure Pt becomes a value larger than the reference value Pth. Accordingly, the ECU 50 waits until the tank side pressure Pt reaches the final value, and determines whether leakage has occurred in the entire space by comparing the final value with the reference value Pth.

In the apparatus according to the embodiment, when a leakage diagnosis for the entire space is completed, a series of processes necessary for a leakage diagnosis is completed. In the example shown in FIGS. 3A to 3D, a leakage diagnosis for the entire space is completed at time t3. When a leakage diagnosis is completed, the open/close valve is closed, and the fuel tank 10 becomes a closed space again, as mentioned above. Accordingly, as shown in FIG. 3D, after time t3, the tank side pressure Pt is kept at a value close to the final value which the tank side pressure Pt reached during the leakage diagnosis.

When a leakage diagnosis is completed, the switching valve 36 is further controlled to be at the atmospheric state realizing position. Also, as shown in FIG. 3C, the booster pump 40 is turned OFF. As a result, after time t3, the canister space becomes open to the atmosphere and the pump side pressure Pp decreases to the atmospheric pressure as shown in FIG. 3D.

Figure 4:
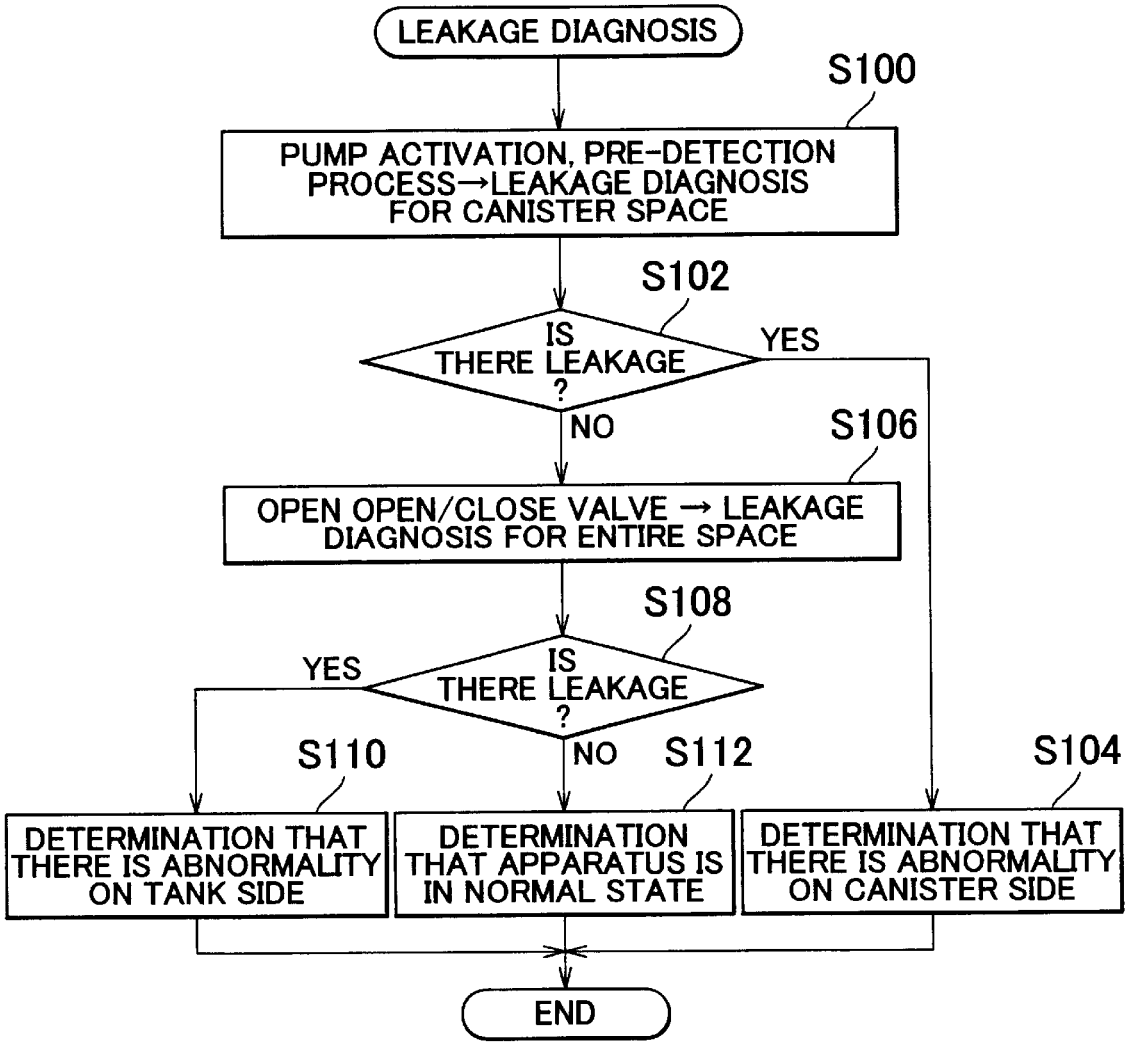
FIG. 4 is a flowchart of a leakage diagnosis routine performed by the apparatus according to the first embodiment.

FIG. 4 shows a flowchart of the control routine which the ECU 50 performs when the above-mentioned leakage diagnosis is performed. The routine shown in FIG. 4 is performed when a predetermined condition is satisfied in a state where the vehicle is parked and therefore each component of the apparatus is in the following state. The open/close valve 20: closed; the purge control valve 30: closed; the switching valve 36: atmospheric state realizing position; the booster pump 40: OFF state.

In the routine shown in FIG. 4, the booster pump 40 is initially turned ON, and the pre-detection process is performed. When the reference value Pth is set in the pre-detection process, the switching valve 36 is controlled to be at the pressurized state realizing position, and a leakage diagnosis for the canister space is performed (step S1100).

When time for converging the pump side pressure Pt has elapsed, it is determined whether there is leakage in the canister space based on the comparison of the pump side pressure Pp with the reference value Pth at this time (step 102).

As a result of the comparison, when it is determined that the pump side pressure Pp is equal to or lower than the reference value Pth (in the case of Pp=Pth), it can be determined that there is leakage in the canister space. In this case, it is determined that there is an abnormality due to leakage in the canister space (step 104), afterwhich the present process cycle is completed.

Meanwhile, when it is determined in step 102 that the pump side pressure Pp is higher than the reference value Pth (in the case of Pp>Pth), it can be determined that there is no leakage in the canister space. In this case, the open/close valve 20 is opened, and a leakage diagnosis for the entire space is performed (step 106).

When time for converging the tank side pressure Pt has elapsed, it is determined whether there is leakage in the entire space, that is, whether there is leakage in the fuel tank 10 based on the comparison of the tank side pressure Pt with the reference value Pth at this time (step 108).

As a result, when it is determined that the tank side pressure Pt is lower than the reference value Pth (in the case of Pt=Pth), it can be determined that there is leakage in the entire space, that is, there is leakage in the fuel tank 10. In this case, it is determined that there is an abnormality due to leakage in the fuel tank 10 (step 110), afterwhich the present process cycle is completed.

Meanwhile, when it is determined in step 108 that the tank side pressure Pt is higher than the reference value Pth (in the case of Pt>Pth), it can be determined that there is no leakage in the entire space. In this case, it is determined that the apparatus is in the normal state (step 112), afterwhich the present process cycle is completed.

As described so far, according to the routine shown in FIG. 4, it is possible to perform diagnosis while the canister space is isolated from the fuel tank 10. Therefore, according to the apparatus in the embodiment, when there is leakage in the canister space, it is possible to detect leakage while identifying the leakage as an abnormality in the canister space.

Also, according to the routine shown in FIG. 4, it is possible to substantially perform a leakage diagnosis for the fuel tanks 10 by performing diagnosis for the entire space after a diagnosis for the canister space. Therefore, according to the apparatus in the embodiment, when there is leakage in the fuel tank 10, it is possible to detect leakage while identifying the leakage as an abnormality in the fuel tank 10.

Further, according to the routine shown in FIG. 4, when leakage is detected in the canister space, it is possible to complete a leakage diagnosis without opening the open/close valve 20. Therefore, according to the apparatus in the embodiment, when leakage has occurred in the canister space, it is possible to minimize the amount of the evaporative fuel leaking from the leakage portion.

The pump side pressure sensor 48 employed in the embodiment is a relative pressure sensor which detects a pressure in the space subject to detection as a relative pressure to the atmospheric pressure. Therefore, in order to accurately detect the pressure in the space subject to detection based on the output from the pump side pressure sensor 48, it is preferable to make a correction to the output from the sensor.

In order to correct the output from the pump side pressure sensor 48, it is necessary to detect the output (hereinafter, referred to as a "reference output") from the pump side pressure sensor 48 when the reference pressure (the atmospheric pressure) is introduced to the space subject to detection. In the embodiment, it is possible to introduce the atmospheric pressure to the space whose pressure is detected by the pressure sensor 48 by controlling the switching valve 36 to be at the atmospheric state realizing position. Accordingly, the ECU 50 can correct the output from the pump side pressure sensor 48 using the output from the sensor, which can be obtained in this state, as the reference output.

Figure 5:
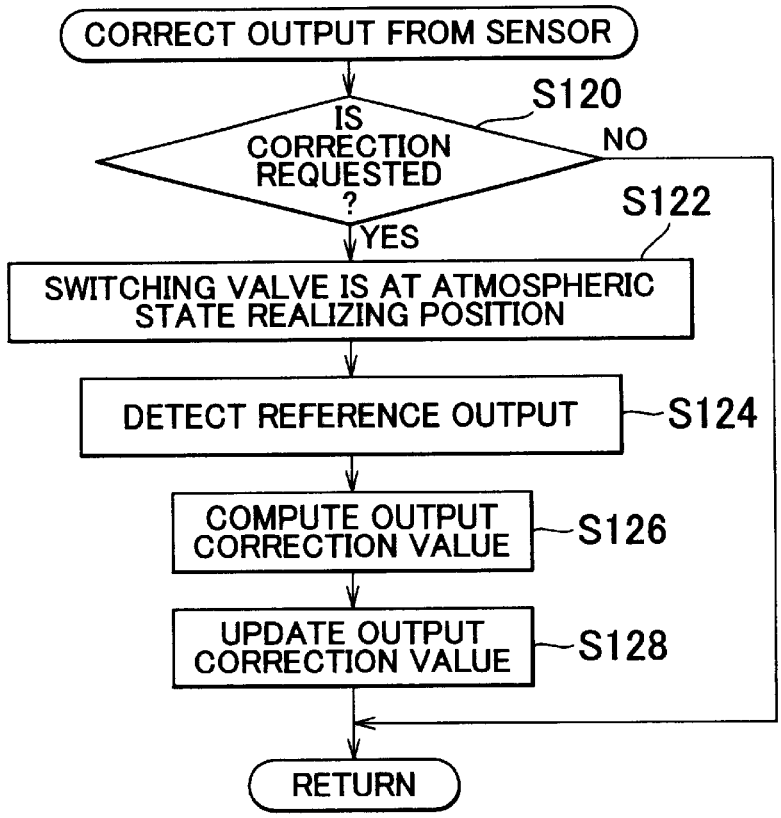
FIG. 5 is a flowchart of a sensor output correction routine performed by the apparatus according to the first embodiment.

FIG. 5 shows a flowchart of a routine performed such that the ECU 50 corrects the output from the pump side pressure sensor 48. In the routine shown in FIG. 5, it is determined whether correction of the output from the sensor is required (step 120).

Correction of the output from the sensor is required each time the internal combustion engine is started, or at predetermined intervals. When it is determined in step 120 that correction is not required, the present process cycle is promptly completed. Meanwhile, when it is determined that correction is required, the open/close valve 36 is controlled to be at the atmospheric state realizing position (step 122).

Next, the output from the pump side pressure sensor 48 is detected. At this time, the atmospheric pressure is introduced to the space whose pressure is detected by the pump side pressure sensor 48. Therefore, according to the process in step 124, it is possible to detect the reference output for the atmospheric pressure, which the pump side pressure sensor 48 (step 124) produces.

Next, an output correction value is computed based on the reference output detected in the process in step 124 (step 126). Then, the output correction value stored in the ECU 50 is updated to the latest output correction value which is computed in step 126 (step 128). After this, the ECU 50 recognizes the pressure introduced to the space whose pressure is detected by the pump side pressure sensor 48 after correcting the output from the pump side pressure sensor 48 using the latest output correction value.

As described so far, according to the routine shown in FIG. 5, it is possible to appropriately correct the output from the pump side pressure sensor 48 at appropriate timing. Therefore, according to the apparatus in the embodiment, it is possible to accurately detect the pressure in the canister space regardless of an individual difference of the pump side pressure sensor 48 or a change with time in the pump side pressure sensor 48.

Modified example of first embodiment will be described below. In the apparatus according to the first embodiment, it is necessary that a state can be realized in which the atmosphere introducing hole 32 of the canister 16 is open to the atmosphere, in order to make it possible to purge the evaporative fuel in the canister 16 (first function). Also, it is necessary that the canister space can be pressurized after the atmosphere introducing hole 32 is isolated from the atmosphere in order to make it possible to perform a leakage diagnosis for this apparatus (second function). The apparatus according to the first embodiment employs the switching valve 36, the booster pump 40 and the check valve 44 so as to realize these two functions.

Figure 6:
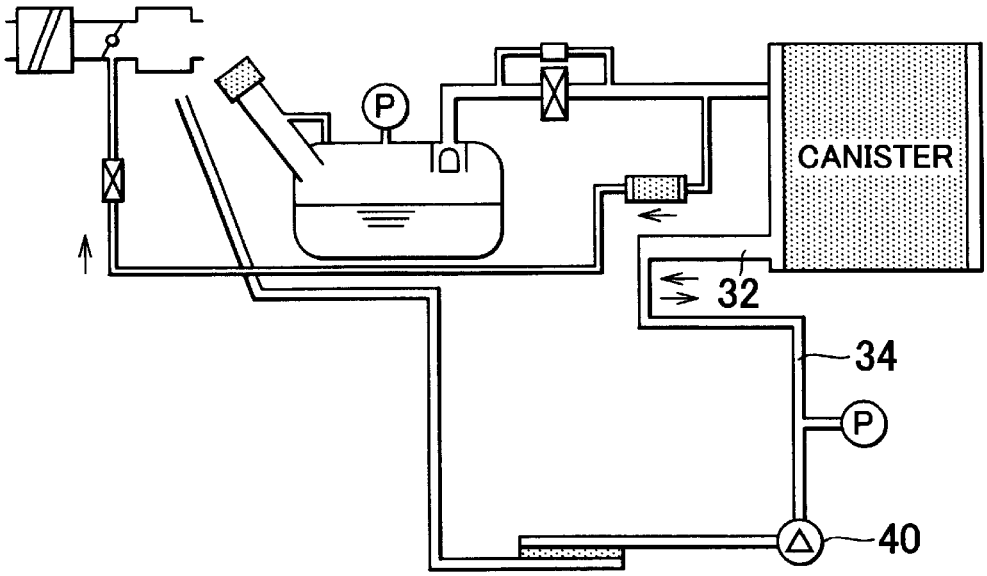
FIG. 6 is a diagram for describing a configuration of a first modified example of the apparatus according to the first embodiment.

However, the configuration for realizing the two functions is not limited to the configuration of the first embodiment. FIG. 6 is a block diagram of a first modified example in which these functions can be realized. In the first modified example, the switching valve 36 and the check valve 44, shown in FIG. 1, are omitted, and only the booster pump 40 is provided in the new atmosphere introducing passage 34. In this configuration, the booster pump 40 has a structure for permitting the countercurrent of the fluid flowing from the discharging opening to the intake opening during non-operation time.

According to this configuration, the first function can be realized by controlling the booster pump 40 to be in the non-operation state. Also, since the atmosphere introducing hole 32 is substantially isolated from the atmosphere during the operation of the booster pump 40, the second function can be realized by operating the booster pump 40. Therefore, according to the first modified example shown in FIG. 6 as well as according to the first embodiment, it is possible to appropriately perform a purge of the evaporative fuel in the canister 16 and the leakage diagnosis for the apparatus.

Figure 7:
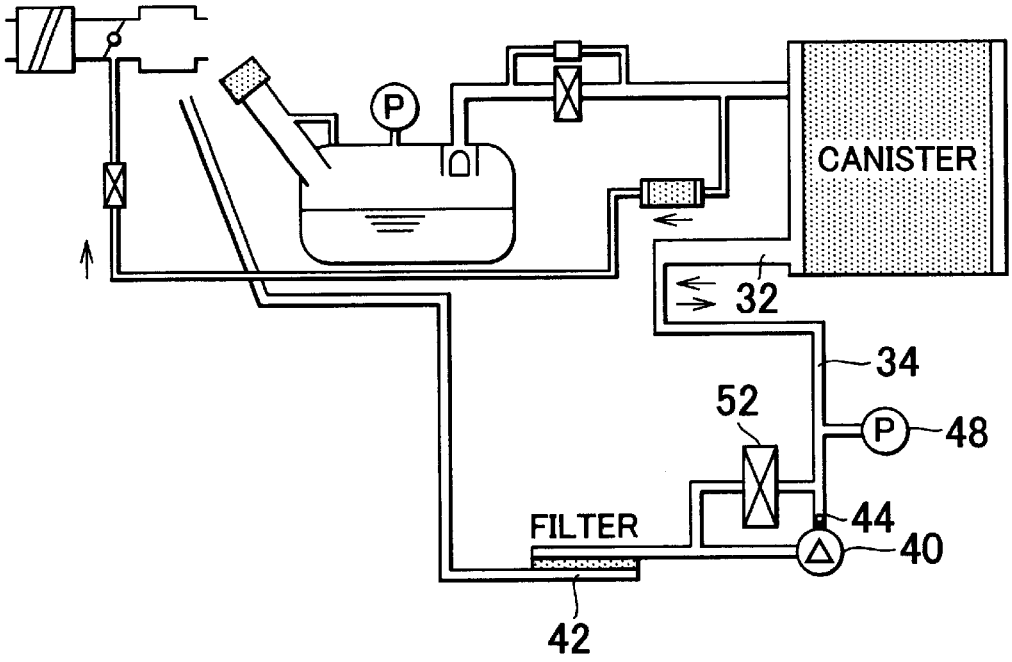
FIG. 7 is a diagram for describing a configuration of a second modified example of the apparatus according to the first embodiment.

FIG. 7 is a block diagram of a second modified example in which the two functions can be realized. In the second modified example, the switching valve 36 is omitted from the configuration shown in FIG. 1, and a CCV (Canister Closed valve) 52 is added to the new atmosphere introducing passage 34 so as to be provided in parallel to the booster pump 40. The CCV 52 is an electromagnetic valve which is kept open when a driving signal is not supplied from the outside, and which closes when the driving signal is supplied.

According to this configuration, it is possible to realize the first function by opening the CCV 52. Also, it is possible to realize the second function by closing the CCV 52 and operating the booster pump 40. Therefore, according to the second modified example shown in FIG. 7 as well as according to the first embodiment, it is possible to appropriately perform a purge of the evaporative fuel in the canister 16 and the leakage diagnosis for the apparatus.

According to the first embodiment, the first modified example, or the second modified example, the canister space or the entire space is pressurized using the booster pump 40 when a leakage diagnosis is performed (hereinafter, such a diagnosis method will be referred to as a "pressurization diagnosis"). However, the method for a leakage diagnosis is not limited to this. For example, a leakage diagnosis may be performed based on the pressure at the pressure reduction time when the booster pump 40 shown in FIGS. 1, 6 and 7 is provided in a reverse direction in the apparatus and make it possible to reduce the pressure in the canister space and the entire space (hereinafter, such a diagnosis method will be referred to as a "pressure reduction diagnosis").

In the case where the pressure reduction diagnosis is employed as a method for a leakage diagnosis, gas containing evaporative fuel may flow from the canister 16 to the new atmosphere introducing passage 34 when a leakage diagnosis is performed. It is possible to capture this flowing evaporative fuel by providing the activated carbon in the filter 42. Also, it is possible to purge the fuel captured by the filter 42 when the fuel in the canister 16 is purged. Accordingly, when the pressure reduction diagnosis is employed as a method for a leakage diagnosis, it is possible to maintain a good emission characteristic.

Further, according to the first embodiment, the first modified example, or the second modified example, pressure adjustment necessary for a leakage diagnosis is performed using the booster pump 40. However, the invention is not limited to this. Namely, the pressure reduction necessary for a leakage diagnosis may be performed using the intake negative pressure and a leakage diagnosis may be performed during the operation of the internal combustion engine.

Figure 8:
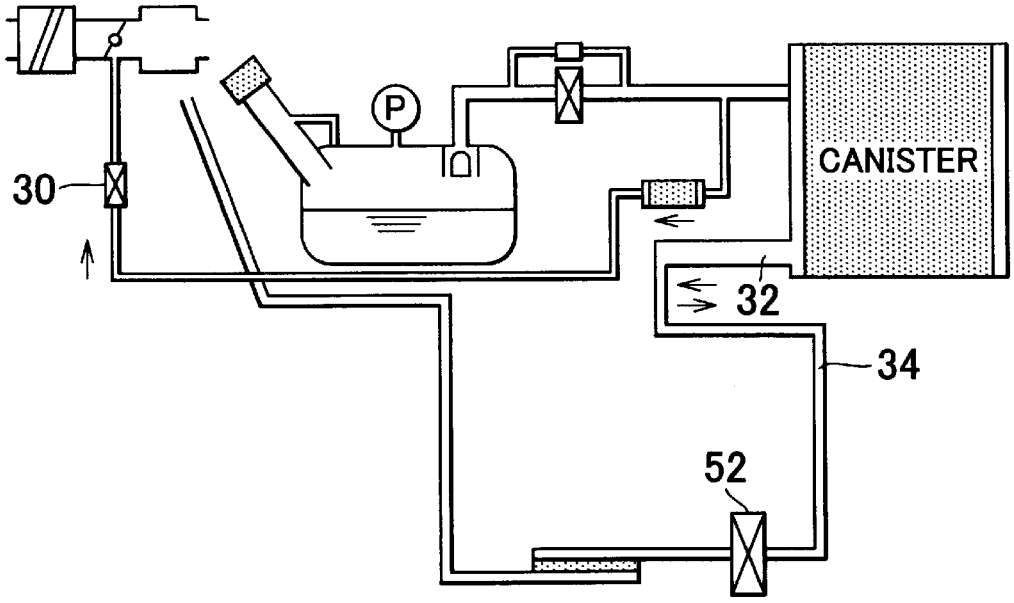
FIG. 8 is a diagram for describing a configuration of a third modified example of the apparatus according to the first embodiment.

FIG. 8 is a block diagram of an apparatus (a third modified example) for performing a leakage diagnosis using the intake negative pressure. In the third modified example, the switching valve 36, the booster pump 40 and the check valve 44 are omitted from the configuration shown in FIG. 1, and the CCV (Canister Closed valve) 52 is added to the new atmosphere introducing passage 34.

According to this configuration, the first function can be realized by opening the CCV 52. It is possible to control the pressure in the closed canister space or the closed entire space to be negative by closing the CCV 52 and opening the purge control valve 30 during the operation of the internal combustion engine (corresponding to the second function). Therefore, according to the third modified example shown in FIG. 8 as well as according to the first embodiment, it is possible to appropriately perform a purge of the evaporative fuel in the canister 16 and a leakage diagnosis for the apparatus.

In the first embodiment, the switching valve 36 serves as one example of an "isolated state switching mechanism" in claims, and the booster pump 40 serves as one example of a "pressure adjusting mechanism" in claims. Also, the ECU 50, the tank side pressure sensor 12 and the pump side pressure sensor 48 serve as one example of a "control system" in claim 1.

In the first embodiment, the pump side pressure sensor 48 serves as one example of a "pressure sensor" in claim 13.

In the first modified example, the booster pump 40 scarves as one example of both an "isolated state switching mechanism" and a "pressure adjusting mechanism" in claims. In the second modified example, the CCV 52 serves as one example of an "isolated state switching mechanism" in claims, and the booster pump 40 serves as one example of a "pressure adjusting mechanism" in claims. Further, in the third modified example, the CCV 52 serves as one of an "isolated state switching mechanism" in claims, and the purge control valve 30 serves as one example of a " purge control valve" in claims and part of the "pressure adjusting mechanism". Namely, in the third modified example, a "pressure adjusting mechanism" may be realized by the internal combustion engine which generates the intake negative pressure, and the purge control valve 30 which introduces the intake negative pressure to the canister 16.

Next, a second embodiment according to the invention will be described with reference to FIGS. 9 and 10. It is possible to realize an evaporative fuel processing apparatus according to the embodiment when the ECU 50 performs the routine shown in FIG. 9 or FIG. 10 instead of the routine shown in FIG. 4 in the configuration (the configuration shown in FIG. 1) of the first embodiment.

Figure 9:
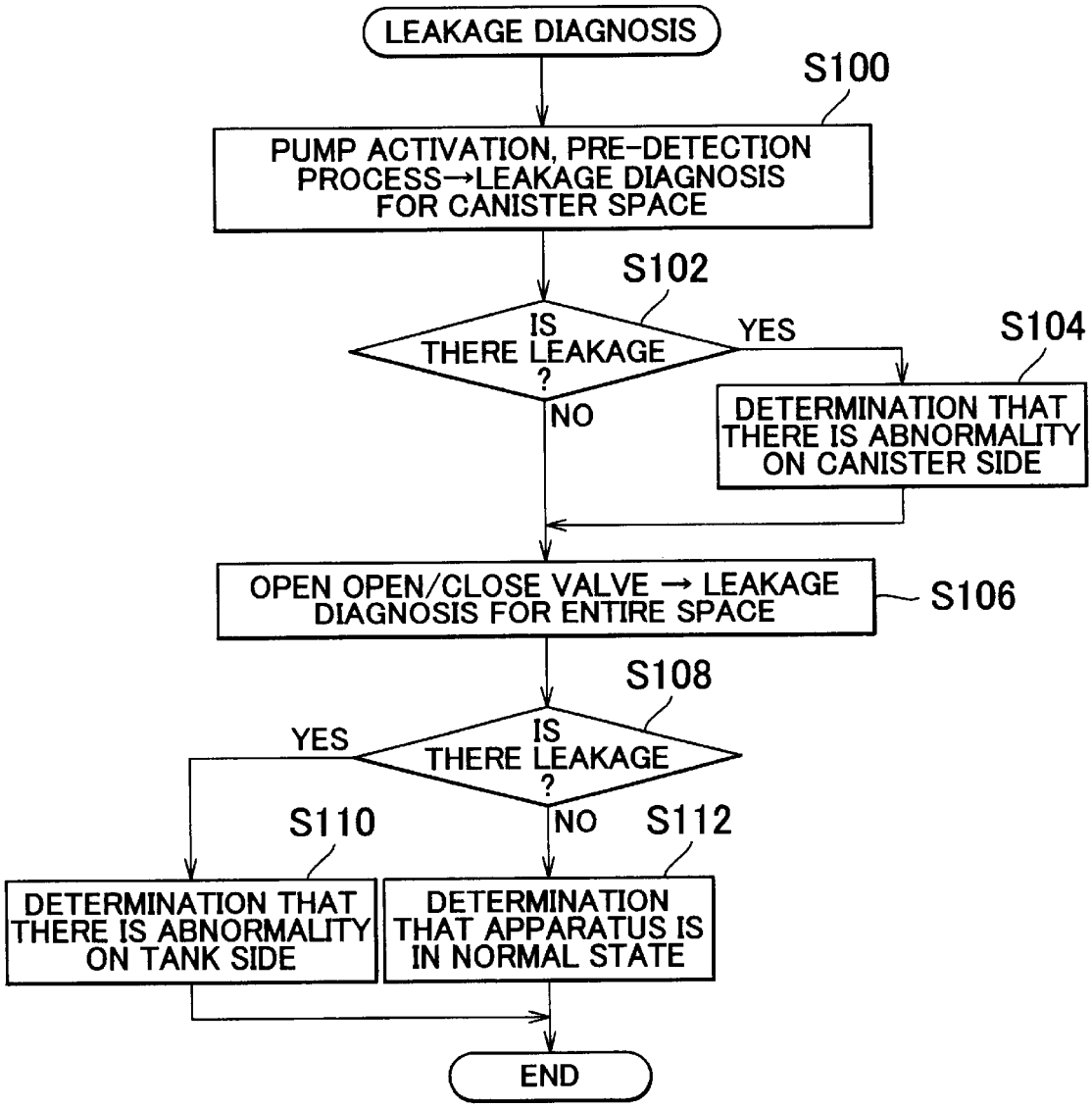
FIG. 9 is a flowchart of a first example of a leakage diagnosis routine performed by an apparatus according to a second embodiment.

FIG. 9 show a flowchart of a first example of the control routine which the ECU 50 performs so as to perform a leakage diagnosis in the embodiment. In FIG. 9, the same reference numerals are assigned to steps in which the same processes are performed as those in steps shown in FIG. 4, and description thereof is omitted or simplified.

The routine shown in FIG. 9 is the same routine as that shown in FIG. 4, except that the processes in step 106 and the following steps are performed subsequent to the process in step 104. Namely, the routine shown in FIG. 9 is different from that shown in FIG. 4 in that even when leakage is detected by performing a leakage diagnosis for the canister space (steps 100 to 104), a leakage diagnosis for the entire space is performed (steps 106 to 112).

According to the routine shown in FIG. 9, even when there is leakage in the canister space, it is possible to perform a leakage diagnosis for the entire space. Therefore, according to the apparatus in the embodiment, for example, when there are leakages in both the canister space and the fuel tank 10, it is possible to detect these leakages simultaneously. Therefore, according to the apparatus in the embodiment, when a plurality of leakages has occurred, the driver is not required to have the vehicle repaired plural times.

Figure 10:
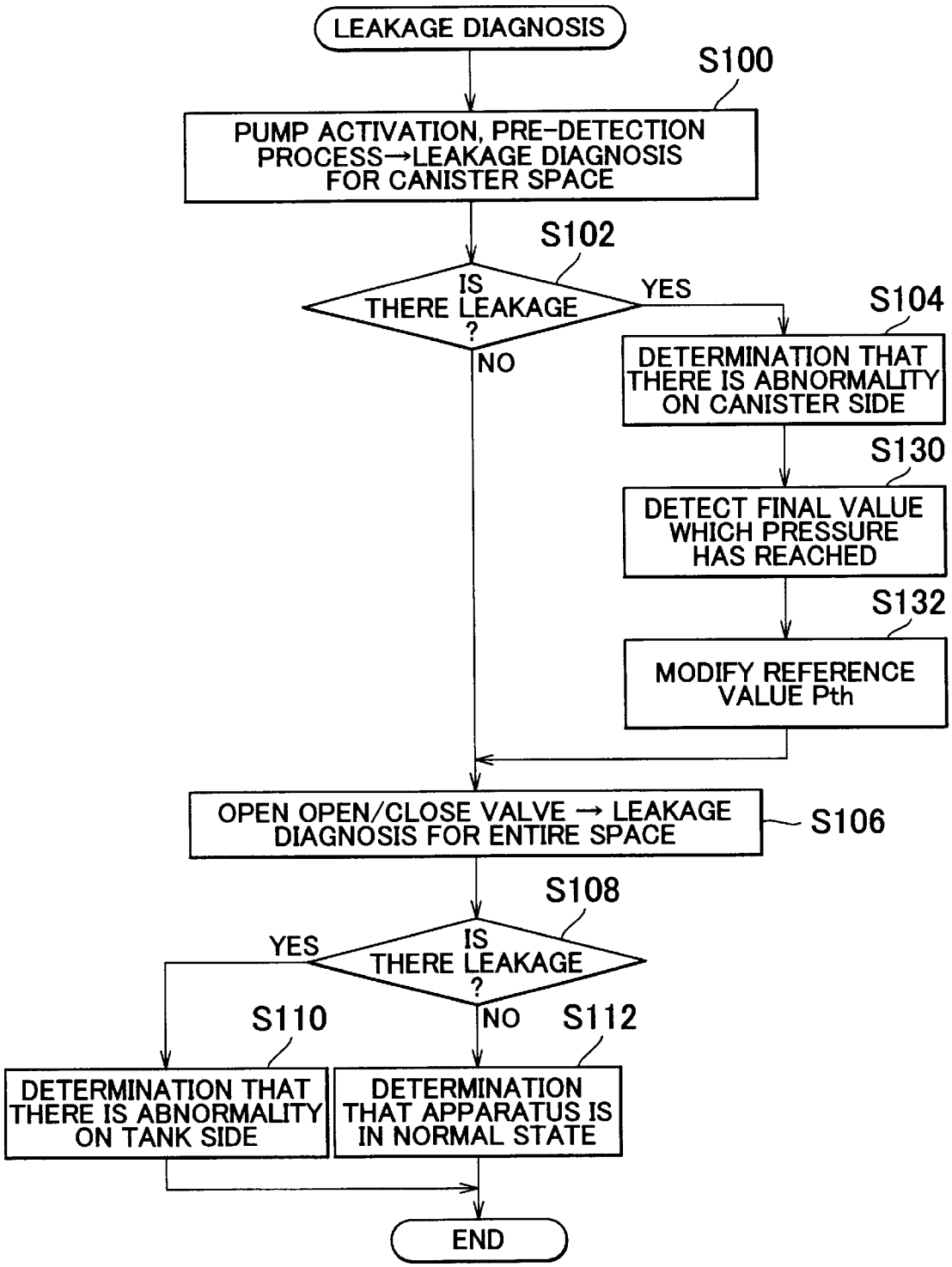
FIG. 10 is a flowchart of a second example of the leakage diagnosis routine performed by the apparatus according to the second embodiment.

FIG. 10 shows a flowchart of a second example of the control routine which the ECU 50 performs so as to perform a leakage diagnosis in the embodiment. In FIG. 10, the same reference numerals are assigned to steps in which the same processes are performed as steps in FIG. 4 (FIG. 9), and description thereof is omitted or simplified.

The routine shown in FIG. 10 is the same routine as that shown in FIG. 9, except that the processes in step 130 and step 132 are performed subsequent to the process in step 104. Namely, in the routine shown in FIG. 10, when leakage is detected by a leakage diagnosis for the canister space (steps 100 to 104), the final value of the pump side pressure Pp, which the pump side pressure has reached in the process of the diagnosis, is detected (step 130).

The detected final value is a value reflecting the effect of the leakage in the canister space. When leakage has not occurred in the fuel tank 10, the pressure in the entire space becomes the value reflecting only the effect of leakage in the canister space, even when a leakage diagnosis for the entire space is performed. Accordingly, in this case, the tank side pressure Pt is supposed to become the final value detected in step 130.

Meanwhile, when leakage has occurred in the fuel tank 10, the pressure in the entire space becomes the value reflecting effects of both leakage in the canister space and leakage in the fuel tank 10 when a leakage diagnosis for the entire space is performed. Accordingly, in this case, the tank side pressure Pt is supposed to become the value which is lower than the final value detected in step 130 (in the case of the pressurized diagnosis).

Accordingly, in the case where there is leakage in the canister space, when a leakage diagnosis for the entire space is performed, it is preferable to use the final value detected in step 102 as the reference value Pth to using the reference value Pth set in the pre-detection process, in order to enhance the accuracy in the diagnosis. Therefore, in the routine shown in FIG. 10, when leakage in the canister space is detected, the reference value Pth used in the leakage diagnosis for the entire space is modified from the value set in the pr-detection process to the final value detected in step 132 (step 132).

When leakage in the canister space has not been detected, the presence or absence of leakage in the entire space, that is, the presence or absence of leakage in the fuel tank 10 is determined based on the reference value Pth set in the pre-detection process in step 108 in the routine shown in FIG. 10, as well as in the case of the routine shown in FIG. 4 or FIG. 9.

Meanwhile, when leakage in the canister space has been detected, it is determined in step 132 whether there is another leakage in the entire space, that is, whether there is leakage in the fuel tank 10 based on the reference value modified in step 132.

According to the above-mentioned process, even when there is leakage in the canister space, it is possible to perform a leakage diagnosis for the entire space, and it is possible to accurately determine the presence or absence of leakage in the entire space, that is, the presence or absence of leakage in the fuel tank 10. Accordingly, when a leakage diagnosis is performed according to the routine shown in FIG. 10, it is possible to realize a more accurate leakage diagnosis as compared with the case in which a leakage diagnosis is performed according to the routine shown in FIG. 9.

The above-mentioned description is made on the assumption that the apparatus according to the second embodiment determines the presence or absence of leakage by performing pressurized diagnosis. However, the invention is not limited to this. Namely, in the apparatus according to the second embodiment as well as in the apparatus according to the first embodiment, the presence or absence of leakage may be determined by performing pressure reduction diagnosis. In the apparatus according to the second embodiment, a leakage diagnosis for the entire space is performed even when there is leakage in the canister space. Accordingly, when diagnosis is performed by the pressurized diagnosis, the gas containing fuel may leak from the leakage portion in the canister space while a leakage diagnosis for the entire space is performed. When the pressure reduction diagnosis is employed as the method for a leakage diagnosis, fuel does not leak from the leakage portion when a leakage diagnosis for the entire space is performed even in the case where leakage has occurred in the canister space. In terms of this, it is preferable to use the apparatus according to the embodiment in combination with the pressurized diagnosis to using it in the combination with the pressure reduction diagnosis.

Also, the above-mentioned description is made on the assumption that the apparatus according to the second embodiment has the same configuration as the apparatus according to the first embodiment, that is the configuration shown in FIG. 1. However, the configuration is not limited to the configuration shown in FIG. 1. Namely, the configuration of the apparatus according to the second embodiment may be any one of the configurations shown in FIGS. 6 to 8.

Next, a third embodiment according to the invention will be described with reference to FIG. 1. An evaporative fuel processing apparatus according to the embodiment can be realized when the ECU 50 performs the routine shown in FIG. 11 instead of the routine shown in FIG. 4 in the configuration (the configuration shown in FIG. 1) of the first embodiment.

Figure 11:
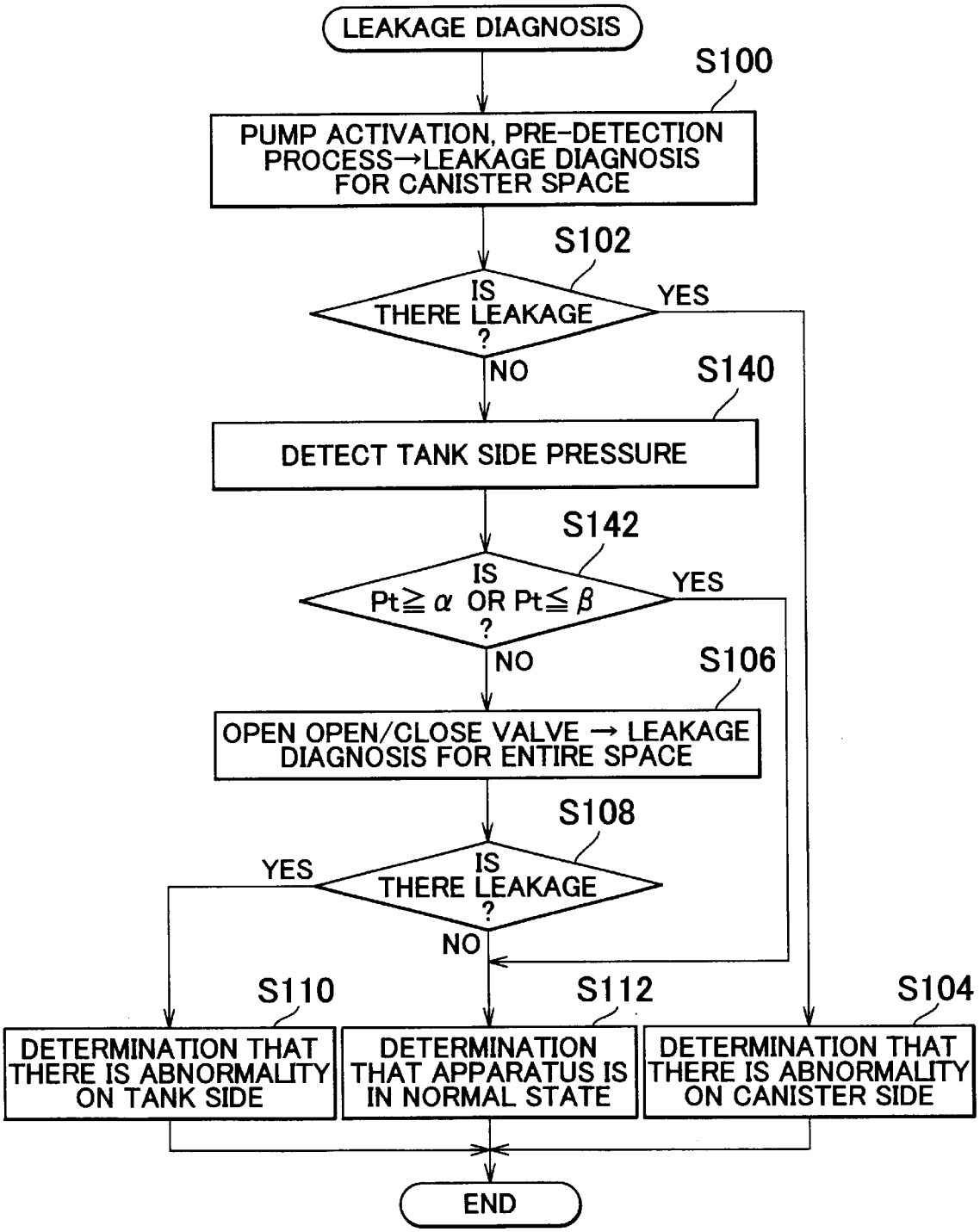
FIG. 11 is a flowchart of the leakage diagnosis routine performed by an apparatus according to a third embodiment.

FIG. 11 shows a flowchart of the control routine which the ECU 50 performs so as to perform a leakage diagnosis in the embodiment. Note that, in FIG. 11, the same reference numerals are assigned to steps in which the same processes are performed as in steps shown in FIG. 4, and description thereof is omitted or simplified.

The routine shown in FIG. 11 is the same as that shown in FIG. 4 except that step 140 and step 142 are inserted between step 102 and step 106. Namely, in the routine shown in FIG. 11, when it is determined in step 102 that there is no leakage in the canister space, the tank side pressure Pt at this time is detected (step 140).

A leakage diagnosis for the canister space is performed while the open/close valve 20 is kept closed. Before the open/close valve 20 is opened, the fuel tank 10 is kept closed. In this case, when leakage has not occurred in the fuel tank 10, the internal pressure in the fuel tank 10 may be a value which greatly deviates from the atmospheric pressure. Meanwhile, when leakage has occurred in the fuel tank 10, the internal pressure in the fuel tank 10 becomes a value close to the atmospheric pressure since pressure is adjusted through the leakage portion. Accordingly, in the apparatus according to the embodiment, when the tank side pressure Pt which greatly deviates from the atmospheric pressure has been generated at the completion of the leakage diagnosis for the canister space, it can be determined at this time that there is no leakage in the fuel tank 10.

In the routine shown in FIG. 11, it is determined subsequent to the process in step 140 whether the tank side pressure Pt is equal to or higher than the positive side reference value α, or is equal to or lower than the negative side reference value β, (step 142). As a result, when it is determined that the condition, Pt=α or Pt=β is satisfied, the process in step 112 is performed, that is, it is determined that the apparatus is in a normal state, without performing a leakage diagnosis for the entire space. Meanwhile, when it is determined that neither of the above-mentioned conditions are satisfied, the processes in step 108 and the following steps are performed, that is, a leakage diagnosis for the entire space is performed, as well as in the routine shown in FIG. 4.

As described so far, according to the routine shown in FIG. 11, when the tank side pressure Pt which greatly deviates from the atmospheric pressure has been generated, it can be determined that the fuel tank 10 is in the normal state without performing a leakage diagnosis for the entire space. Therefore, according to the evaporative fuel processing apparatus in the embodiment, it is possible to complete a leakage diagnosis for the entire space more efficiently than in the first embodiment.

The above description is made on the assumption that the apparatus according to the third embodiment has the configuration shown in FIG. 1. However, the configuration is not limited to this. Namely, the configuration of the apparatus according to the third embodiment as well as the configuration of the apparatus according to the first embodiment may be any one of the configurations shown in FIGS. 6 to 8.

In the third embodiment, the processes (the processes in step 140 and step 142) for determining whether the tank side pressure Pt which greatly deviates from the atmospheric pressure has been generated are combined with the routine (the routine shown in FIG. 4) employed in the first embodiment. However, the invention is not limited to this. Namely, these processes may be combined with the routine (the routine shown in FIG. 9 or FIG. 10) employed in the second embodiment.

Next, a fourth embodiment according to the invention will be described with reference to FIG. 12. An evaporative fuel processing apparatus according to the embodiment can be realized when the ECU 50 performs the routine shown in FIG. 12 in the configuration in FIG. 1.

Figure 12:
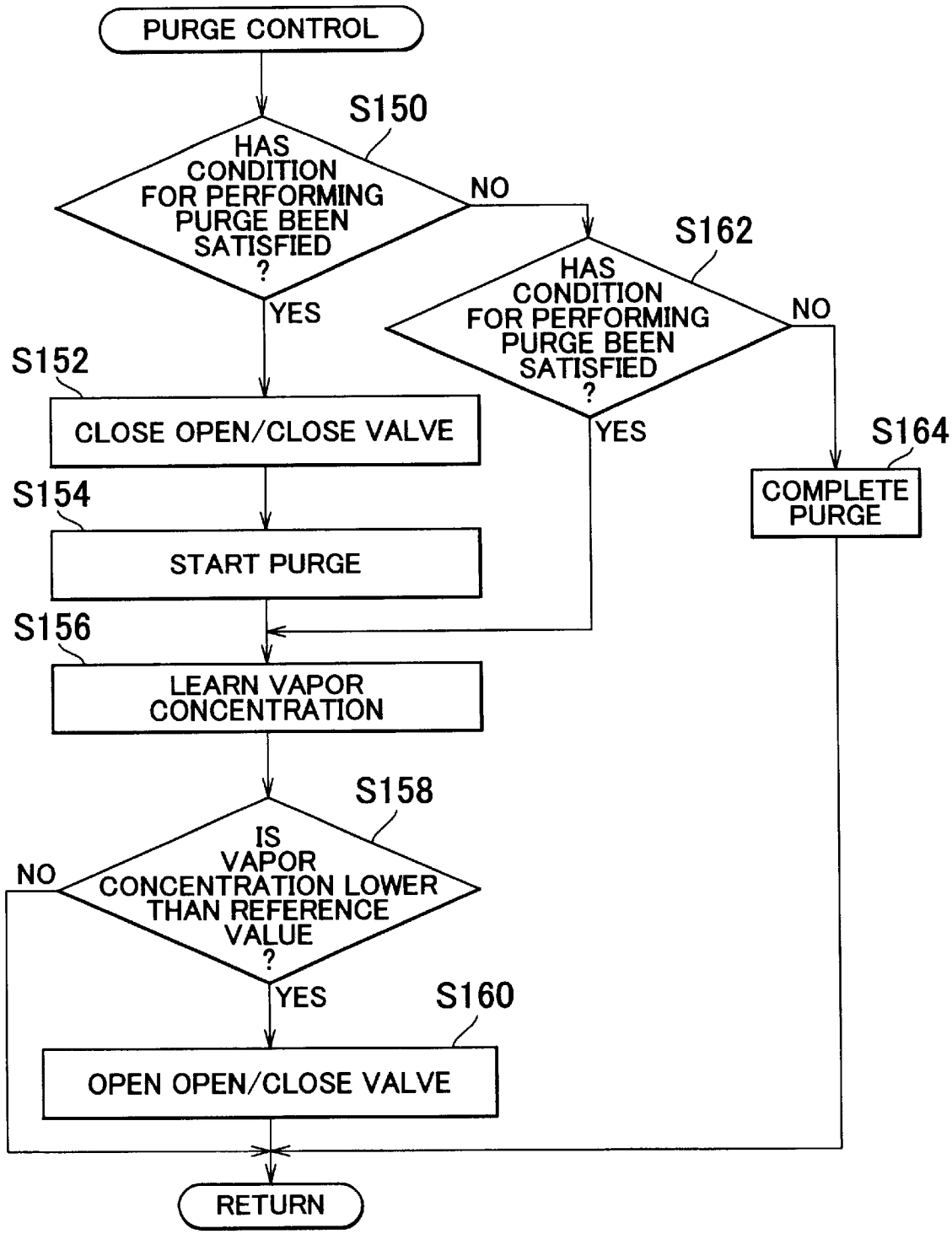
FIG. 12 is a flowchart of a purge control routine performed by an apparatus according to a fourth embodiment.

FIG. 12 shows a flowchart of a control routine which the ECU 50 performs so as to purge the fuel stored in the canister 16 to the intake passage 24 of the internal combustion engine. In the routine shown in FIG. 12, it is initially determined whether the condition for performing a purge has been satisfied in the present process cycle, which was not satisfied in the previous process cycle (step 150).

As a result, when it is determined that the condition for performing a purge has been satisfied in the present process cycle, which was not satisfied in the previous process cycle, the open/close valve 20 is closed (step 152). The routine shown FIG. 12 is the routine which is performed during the operation of the internal combustion engine (while the vehicle is running). The open/close valve 20 is kept open in principle while the vehicle is running in the embodiment as well as in the first embodiment. Therefore, according to the process in step 152, it is possible to open the open/close valve which has been closed.

In the routine shown in FIG. 12, purge of the evaporative fuel is started (step 154). When the process in step 154 is performed, the switching valve 36 is kept at the atmospheric state realizing position such that an appropriate amount of the purge gas flows from the canister 16 to the intake passage 24, and the purge control valve 30 is driven at an appropriate duty ratio.

Next, the vapor concentration in the purge gas purged to the intake passage 24 is learned (step 156). It is possible to learn the vapor concentration by a known method based on the deviation in the exhaust air-fuel ratio which is generated due to the purge gas flowing into the intake passage 24, or based on the amount of correction made to the fuel injection amount in order to correct the deviation.

In the routine shown in FIG. 12, it is determined whether the learned vapor concentration is lower than the predetermined reference value (step 158).

As a result, when it is determined that the vapor concentration is not lower than the reference value, it can be determined that a large amount of fuel has been stored in the canister 16. Namely, it can be determined that the fuel in the canister 16 needs to be purged promptly. In this case, in the routine shown in FIG. 12, the present process cycle is completed while the open/close valve is kept closed.

Meanwhile, when it is determined in step 158 that the vapor concentration is lower than the reference value, it can be determined that the amount of the fuel stored in the canister 16 is small. Namely, in this case, it can be determined that purge of the fuel in the canister 16 has been almost completed. In this case, in the routine shown in FIG. 12, the open/close valve 20 is opened (step 160), afterwhich the present process cycle is completed.

When it is determined in the routine shown in FIG. 12 that the condition in step 150 is not satisfied, it is determined whether the purge condition has been satisfied (step 162).

As a result, when it is determined that the purge condition itself has been satisfied, the processes in step 156 and the following steps are performed. Meanwhile, when it is determined that the purge condition itself has not been satisfied, the process for completing purge of the evaporative fuel is performed, such as closing the purge control valve 30, afterwhich the present process cycle is completed.

According to a series of the above-mentioned processes, it is possible to learn the vapor concentration in the purge gas while the open/close valve 20 is kept closed after purge of the evaporative fuel is started. In this case, it is possible to allow only the gas flowing out of the canister 16 to flow into the intake passage 24 as the purge gas. Namely, it is possible to allow the purge gas which does not contain evaporative fuel generated in the fuel tank to flow into the intake passage 24.

In this case, the vapor concentration learned in the process in step 156 becomes a value that accurately reflects the storage state of the fuel in the canister 16. Therefore, according to the apparatus in the embodiment, it is possible to detect the vapor concentration in the purge gas as a value which accurately indicates the storage state of the fuel in the canister 16.

Also, according to the above-mentioned series of the processes, it is possible to purge the fuel in the canister 16 at the highest priority while the open/close valve is kept closed, during a period in which the vapor concentration is high after purge of the evaporative fuel is started. Therefore, according to the apparatus in the embodiment, when it is necessary to promptly purge the fuel in the canister 16, for example when a large amount of fuel has been stored in the canister, it is possible to promptly purge the fuel. Then, after the fuel stored in the canister 16 has appropriately decreased, it is possible to appropriately purge the evaporative fuel generated in the fuel tank into the intake passage 24 by performing a purge while the open/close valve 20 is kept open.

The above-mentioned description is made on the assumption that the apparatus according to the fourth embodiment has the configuration shown in FIG. 1. However, the configuration is not limited to this. Namely, the configuration of the apparatus according to the fourth embodiment as well as the configuration of the apparatus according to the first embodiment may be any one of the configurations shown in FIGS. 6 to 8.

Figure 13:
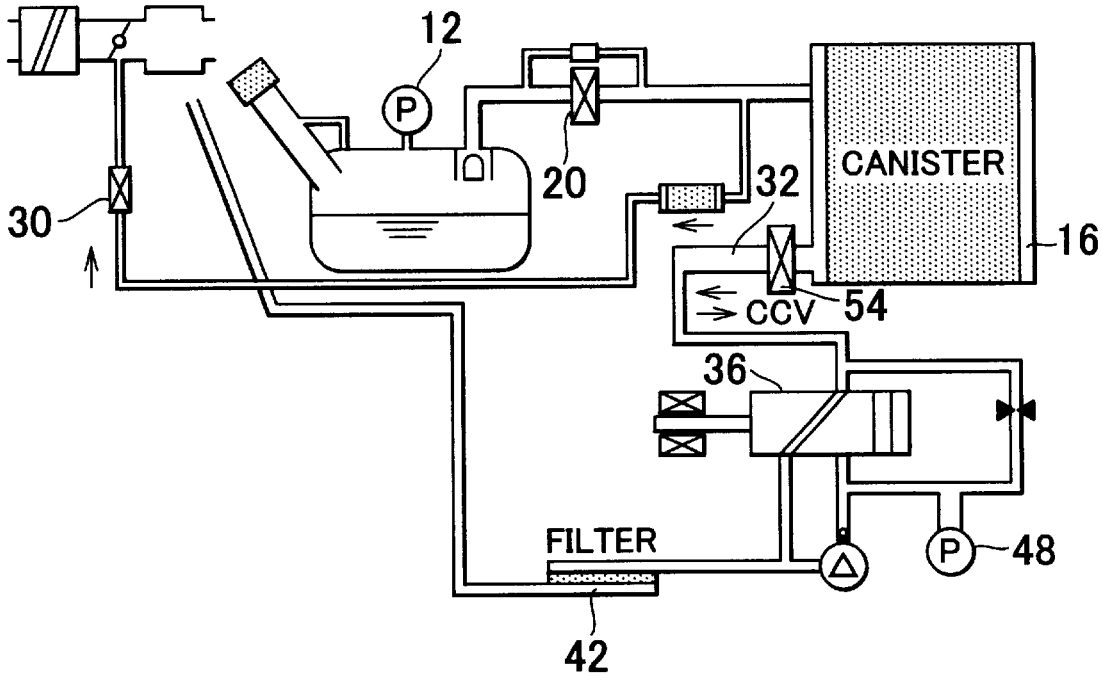
FIG. 13 is a diagram for describing a configuration of an evaporative fuel processing apparatus according to a fifth embodiment.

Next, a fifth embodiment according to the invention will be described with reference to FIG. 13 and FIG. 14. FIG. 13 is a diagram for describing a configuration of an evaporative fuel processing apparatus according to the embodiment. The evaporative fuel processing apparatus shown in FIG. 13 has the same configuration in the first embodiment, except that a CCV 54 is provided in the atmosphere introducing hole 32 of the canister 16. The CCV 54 is an electromagnetic valve which is kept open while a driving signal is not supplied from the outside, and which closes when a driving signal is supplied.

The evaporative fuel processing apparatus according to the embodiment as well as the apparatus according to the first embodiment performs a leakage diagnosis for the apparatus by the method of the pressurized diagnosis, and closes the open/close valve 20 and controls the switching valve 36 to be at the atmospheric state realizing position at the completion of the leakage diagnosis, (refer to time t3 in FIG. 3A, and FIG. 3B). When a leakage diagnosis is performed by the pressurized diagnosis, a pressure higher than the atmospheric pressure remains in the canister 16 and the fuel tank 10 at the completion of the leakage diagnosis (refer to time t3 in FIG. 3D).

When the canister 16 is controlled to be open to the atmosphere while such a high pressure remains in the canister 16, the gas containing fuel may flow from the inside of canister 16 to the atmosphere. Therefore, the apparatus according to the embodiment closes the CCV 54 during the period in which a high pressure remains in the canister 16 after the completion of the leakage diagnosis by the pressurized diagnosis so as to isolate the canister 16 from the atmosphere.

Figure 14:
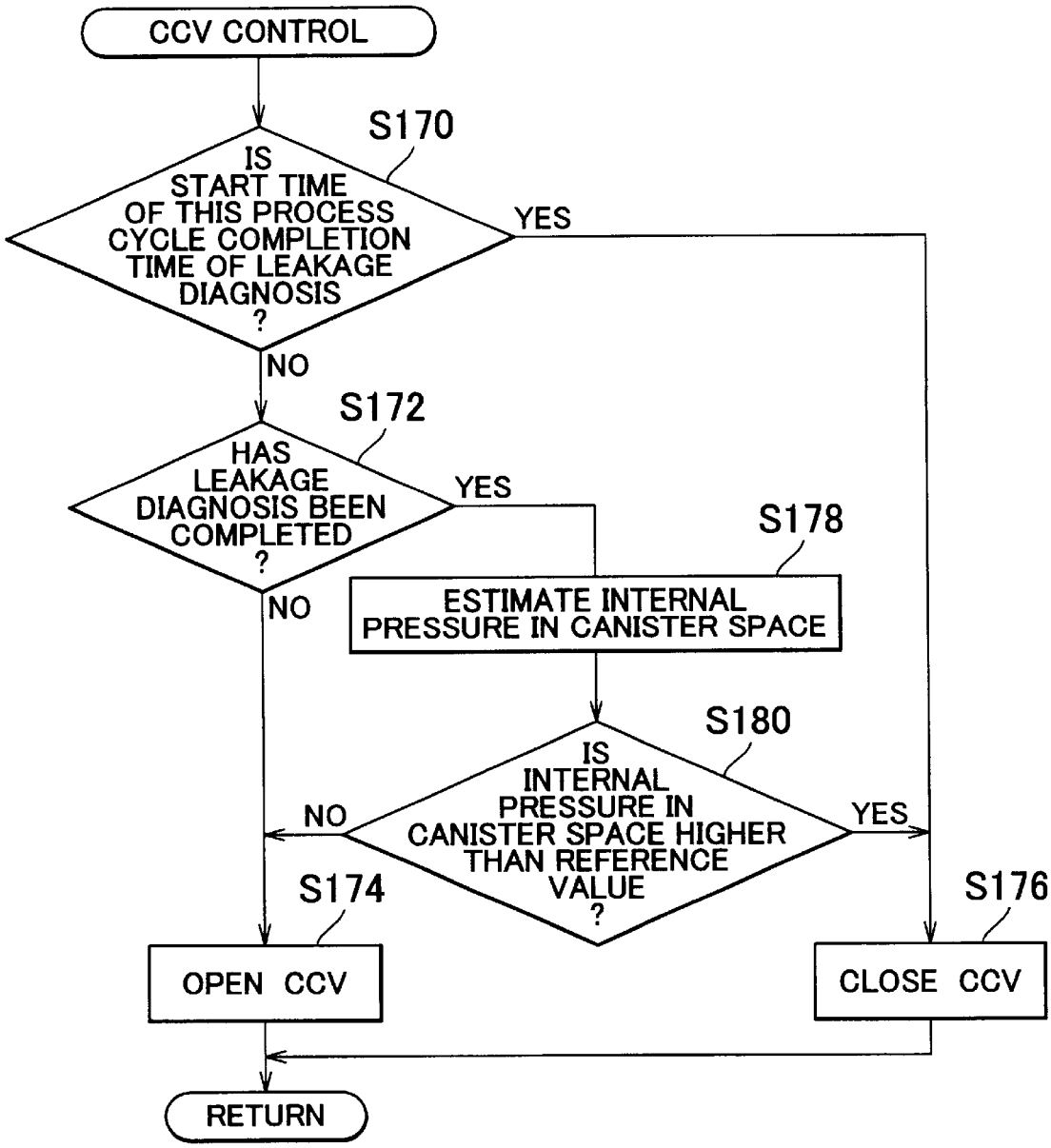
FIG. 14 is a flowchart of a CCV control routine performed by the apparatus according to the fifth embodiment.

FIG. 14 shows a flowchart of the control routine which the ECU 50 performs in the embodiment so as to realize the above-mentioned function. In the routine shown in FIG. 14, it is initially determined whether the start time of the present process cycle is the completion time of the leakage diagnosis (step 170).

As a result, when it is determined that the start time of the present process cycle is not the completion time of the leakage diagnosis, it is determined whether the leakage diagnosis has been completed (step 172).

When it is determined in step 172 that the leakage diagnosis has not been completed, it can be determined that the leakage diagnosis has not been started, or the leakage diagnosis is being performed. When the leakage diagnosis has not been started, it is preferable that the CCV 54 should be kept open since it is not necessary to isolate the canister 16 from the atmosphere. During the leakage diagnosis, it is necessary that the CCV 54 is kept open. Accordingly, when the condition in step 172 is not satisfied, the CCV 54 is opened (step 174).

When a leakage diagnosis is started and then completed, the condition in step 170 is satisfied at this time. As mentioned above, at the completion of the leakage diagnosis, the switching valve 36 is controlled to be at the atmospheric state realizing position again while a high pressure remains in the canister 16. Accordingly, in the routine shown in FIG. 14, when the condition in step 170 is satisfied, the CCV 54 is opened so as to prevent the fuel from leaking from the canister 16 to the atmosphere (step 176).

When the routine shown in FIG. 14 is restarted after a leakage diagnosis is completed, it is determined that the leakage diagnosis has been completed in step 172. In this case, the internal pressure in the canister 16 is estimated (step 178).

In the apparatus according to the embodiment, the open/close valve 20 and the CCV 54 are closed simultaneously with the completion of the leakage diagnosis. Accordingly, when step 178 is performed, it is impossible to measure the internal pressure in the canister 16 neither by the tank side pressure sensor 12 nor by the pump side pressure sensor 48. Therefore, in the routine shown in FIG. 14, the internal pressure in the canister 16 is estimated in step 178 according to the rule predetermined.

It is possible to estimate the internal pressure in the canister 16 as a function of the time which has elapsed since the completion of the leakage diagnosis using the pressure (the pump side pressure Pp or the tank side pressure Pt) at the completion of the leakage diagnosis as an initial value. The internal pressure in the canister 16 may be estimated on the assumption that a substantially constant pressure is maintained until the purge control valve 30 is opened after the completion of the leakage diagnosis, and the pressure decreases to a value close to the atmospheric pressure when the purge control valve 30 is opened.

In the routine shown in FIG. 14, it is determined subsequent to the process in step 178 whether the internal pressure in the canister 16 is higher than the predetermined reference pressure (step 180).

The predetermined reference pressure is a pressure higher than the atmospheric pressure, and is a value for determining whether the gas containing fuel flows from the canister 16 to the atmosphere when the CCV 54 is opened. Accordingly, when it is determined in step 180 that the internal pressure in the canister 16 is higher than the reference value, it can be determined that the CCV 54 should not be opened. In this case, in order to keep the CCV 54 closed, the process in step 176 is performed, afterwhich the present process cycle is completed.

Meanwhile, when it is determined in step 180 that the internal pressure in the canister 16 is not higher than the reference pressure, it can be determined that the fuel leakage does not occur even when the CCV 54 is opened. Accordingly, when such determination is made, the process in step 174 is performed so as to open the CCV 54, afterwhich the present process cycle is completed.

As described so far, according to the routine shown in FIG. 14, the canister 16 is prevented from being opened to the atmosphere while the internal pressure in the canister 16 is being increased by performing a leakage diagnosis by the pressurized diagnosis. Therefore, according to the evaporative fuel processing apparatus in the embodiment, the gas containing fuel can be prevented from leaking from the canister into the atmosphere, therefor it is possible to realize an emission characteristic superior to that of the apparatus according to the first embodiment.

In the fifth embodiment, since priority is given to isolating the fuel tank 10 and the canister 16 from each other while the vehicle is parked, the open/close valve 20 is closed at the completion of the leakage diagnosis. However, the open/ close valve 20 may be kept open even while the vehicle is parked until the internal pressure in the canister 16 becomes equal to or lower than the reference pressure after the completion of the leakage diagnosis, and the internal pressure may be measured by the tank side pressure sensor 12.

In the fifth embodiment, the internal pressure in the canister 16 is estimated after the completion of the leakage diagnosis, and when the internal pressure decreases to the reference pressure, the CCV is opened. However, the invention is not limited to this. Namely, the processes such as the estimation of the internal pressure in the canister and the like may be omitted, and the CCV 54 may be kept closed until purge of the evaporative fuel is required, after the completion of the leakage diagnosis.

In the fifth embodiment, the CCV 54 is closed only after the completion of the leakage diagnosis. However, the invention is not limited to this. Namely, the CCV 54 may be closed at all times when the internal pressure in the canister 16 increases in the case in which there is not any positive reason for opening the CCV 54, for example, in the case in which purge of the evaporative fuel is required.

The above description is made on the assumption that the apparatus according to the fifth embodiment has a configuration shown in FIG. 13, that is, the configuration formed by adding the CCV 54 to the configuration shown in FIG. 1. However, the configuration is not limited to the configuration shown in FIG. 13. Namely, it is possible to realize the apparatus according to the fifth embodiment by employing the configuration formed by adding the CCV 54 to the configuration shown in FIG. 6.

It is possible to realize the apparatus according to the fifth embodiment by controlling the CCV 52 in FIG. 7 in the same manner as in the case of the CCV 54 in FIG. 13 using the configuration shown in FIG. 7. In this case, it is possible to measure the internal pressure in the canister 16 even when the CCV 52 is closed. Accordingly, when the configuration shown in FIG. 7 is employed, it is possible to control the opening time of the CCV 52 based on the measured value of the internal pressure in the canister 16.

The apparatus (the configuration shown in FIG. 13) according to the fifth embodiment employs the CCV 54 which is kept open during non-driving time, as a mechanism for isolating the canister 16 from the atmosphere. However, the invention is not limited to this. Namely, the mechanism may be realized by an open/close valve which is kept closed during non-driving time.

In the above description, the CCV 54 shown in FIG. 13 or the open/close valve which is a substitute for the CCV 54 is provided alone in the atmosphere introducing hole 32 of the canister 16. However, the invention is not limited to this. Namely, a mechanical positive/negative pressure valve may be provided in the atmosphere introducing hole 32 in parallel with the CCV 54 or the open/close valve.

In the above description, the CCV 54 shown in FIG. 13, the open/close valve which is a substitute for the CCV 54, or the combination of at least one of them and the positive/negative pressure valve is provided in the atmosphere introducing hole 32 of the canister 16. However, the invention is not limited to this. Namely, any one of these mechanisms may be provided between the switching valve 36 and the booster pump 40, and the filter 42. According to such an arrangement, it is possible to measure the internal pressure in the canister 16 using the pump side sensor 48 even when the CCV 54 or the open/close valve is kept closed. Accordingly, when the above-mentioned arrangement is employed, it is possible to control the opening time of the CCV 54 or the open/close valve based on the measured value of the internal pressure in the canister 16.

In the above description, the CCV 54, the open/close valve, or the combination of at least one of them and the positive/negative pressure valve is provided only either in the atmosphere introducing hole 32 or immediately behind the filter 42. However, the invention is not limited to this. Namely, one of these mechanisms may be provided both in the atmosphere introducing hole 32 and immediately behind the filter 42. Further, when the above-mentioned mechanism is provided at both of the above-mentioned positions, the CCVs 54 may be provided at both of these positions, the open/close valves may be provided at both of these positions, or the CCV 54 may be provided at one of these positions, and the open/close valve may be provided at the other position.

In the eleventh embodiment, the CCV 54 serves as one example of part of "the isolated state switching mechanism" in the first aspect of the invention.

Figure 15:
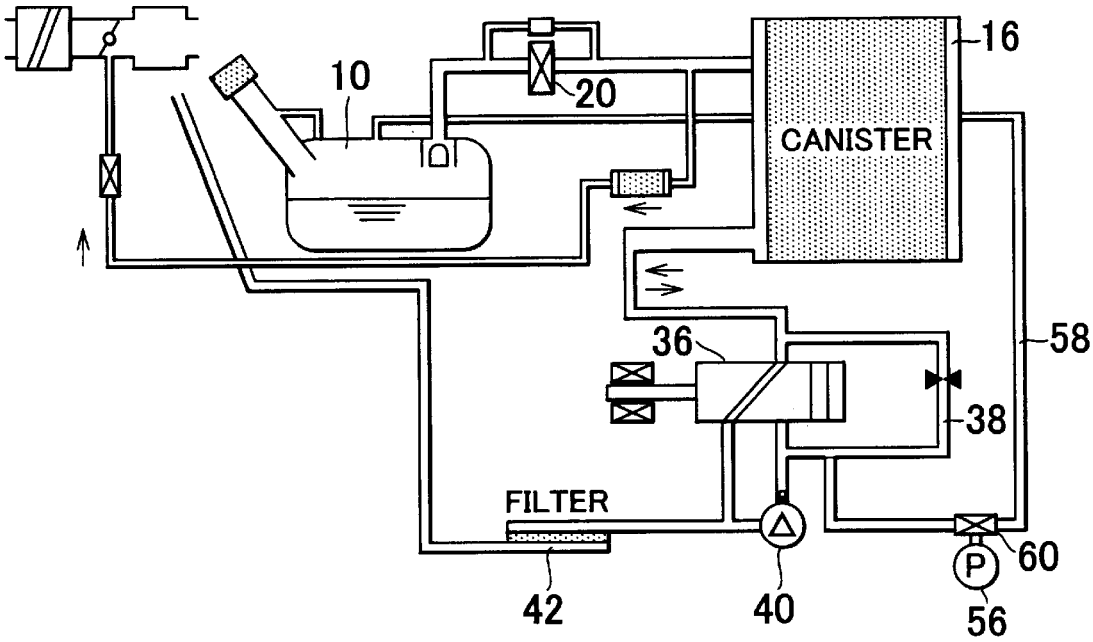
FIG. 15 is a diagram for describing a configuration of an evaporative fuel processing apparatus according to a sixth embodiment.

Next, a sixth embodiment according to the invention will be described with reference to FIGS. 15 to 17. FIG. 15 is a diagram for describing a configuration of an evaporative fuel processing apparatus according to the embodiment. The configuration shown in FIG. 15 is the same as that shown in FIG. 1, except for the following points. (1) The tank side pressure sensor 12 and the pump side pressure sensor 48 are removed, and a pressure sensor 56 is included instead of them. (2) A communicating passage 58 is provided which allows the bypass passage 38 and the fuel tank 10 to communicate with each other. (3) A three-way valve 60 is provided which connects the pressure sensor 56 to the communicating passage 58.

The three-way valve 60 is an electromagnetic valve controlled by the ECU 50 (not shown in FIG. 15). According to the three-way valve 60, it is possible to selectively realize the following states (a pump side state and a tank side state). In the pump side state, the pressure in the bypass passage 38 is introduced to the space whose pressure is detected by the pressure sensor 56. In the tank side state, the internal pressure in the fuel tank 10 is introduced to the space whose pressure is detected by the pressure sensor 56. Hereafter, the pressure, which is detected by the pressure sensor 56 when the three-way valve 60 realizes the pump side state, will be referred to as a "pump side pressure Pp" and the pressure, which is detected by the pressure sensor 56 when the three-way valve 60 realizes the tank side state, will be referred to as a "tank side pressure Pt".

According to the evaporative fuel processing apparatus in the embodiment, it is possible to allow the pressure sensor 56 to function in the same manner as the pump side pressure sensor 48 shown in FIG. 1 by controlling the three-way valve 60 to be at the pump side state realizing position. Also, it is possible to allow the pressure sensor 56 to function in the same manner as the tank side pressure sensor 12 shown in FIG. 1 by controlling the three-way valve 60 to be at the tank side state realizing position. Therefore, according to the apparatus in the embodiment, it is possible to realize the same function as in the first embodiment using the single pressure sensor 56.

Figure 16:
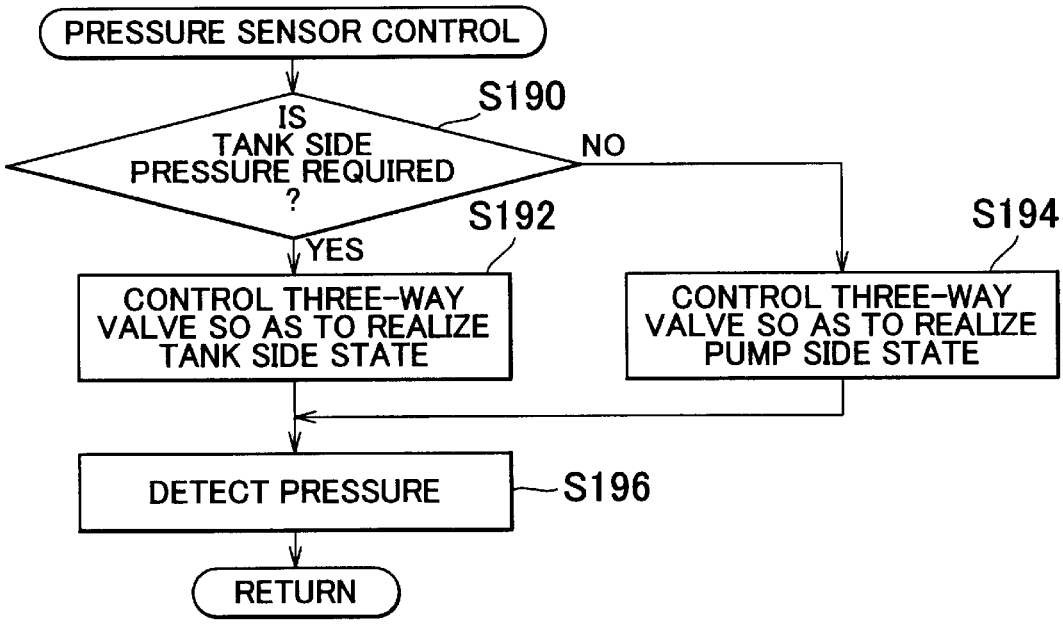
FIG. 16 is a flowchart of a pressure sensor control routine performed by the apparatus according to the sixth embodiment.

FIG. 16 is a flowchart of a routine which the ECU 50 performs so as to switch a state in which the pressure sensor 56 functions as the pump side pressure sensor 48 and a state in which the pressure sensor 56 functions as the tank side pressure sensor 12. In the routine shown in FIG. 16, it is initially determined whether the tank side pressure Pt is required by the ECU 50 (step 190).

As a result, when it is determined that the tank side pressure Pt is required, the three-way valve 60 is controlled so as to realize the tank side state (step 92). Meanwhile, when it is determined that the tank side pressure Pt is not required, the three-way valve 60 is controlled so as to realize the pump side state (step 194).

In the routine shown in FIG. 16, the pressure detection is performed using the pressure sensor 56 subsequent to the process in step 192 or step 194 (step 196).

The ECU 50 recognizes the detected pressure as the tank side pressure Pt when the process in step 196 is performed via step 192. Meanwhile, when the process in step 196 is performed via step 194, the ECU recognizes the detected pressure as the pump side pressure Pp. Accordingly, the ECU 50 can detect both the pump side pressure Pp and the tank side pressure Pt as necessary, as well as in the first embodiment.

As mentioned above, the apparatus according to the first embodiment can correct the output from the pump side pressure sensor 48 by performing the routine shown in FIG. 5. Likewise, the apparatus according to the embodiment can correct the output from the pressure sensor 56 by controlling the three-way valve 60 to be at the pump side state realizing position and the performing the routine shown in FIG. 5. Therefore, according to the evaporative fuel processing apparatus in the embodiment, it is possible to detect both the pump side pressure Pp and the tank side pressure Pt using the pressure sensor 56 whose output is appropriately corrected using the atmospheric pressure as a reference pressure.

Next, details on the processes which the apparatus according to the embodiment performs so as to detect an abnormality in the pressure sensor 56 will be described. FIG. 17 shows a flowchart of the control routine which the ECU 50 performs so as to detect an abnormality in the pressure sensor 56. It is initially determined in this routine whether purge of the evaporative fuel is performed while the open/close valve 20 is kept open (step 200).

As a result, when it is determined that the above-mentioned condition is not satisfied, the present process cycle is promptly completed. Meanwhile, when it is determined that purge is performed while the open/close valve 20 is kept open, the tank side pressure Pt is detected (step 202). When detection of the tank side pressure Pt is required, the three-way valve 60 is controlled to be on the fuel tank 10 side in the process (FIG. 16) in step 192. As a result, the ECU 50 can detect the output from the pressure sensor 56 as the tank side pressure Pt.

Detection of the tank side pressure Pt is performed for a predetermined time (step 204). When the predetermined time has elapsed, it is determined whether a change has occurred in the output from the pressure sensor 56 (step 206).

In the case where purge is performed while the open/close valve 20 is kept open, the internal pressure in the fuel tank 10 changes when the intake negative pressure is introduced to the tank 10. Accordingly, when the pressure sensor 56 functions properly, a change is to occur in the output from the pressure sensor 56 in step 204. Therefore, when it is determined in step 206 that there is no change in the output from the sensor, it is determined that there is an abnormality in the pressure sensor 56 (step 208), afterwhich the present process cycle is completed.

Meanwhile, when it is determined in step 206 that there is a change in the output from the pressure sensor 56, the atmospheric pressure is detected (step 210). When detection of the atmospheric pressure is required, the three-way valve 60 is controlled to be on the booster pump 40 side in the process (FIG. 16) in step 194. Also, step 210 is performed during execution of purge, that is, while the switching valve 36 is at the atmospheric state realizing position. In this case, since the atmospheric pressure is introduced to the space whose pressure is detected by the pressure sensor 56, the ECU 50 can detect the atmospheric pressure based on the output from the sensor.

Detection of the atmospheric pressure is performed for a predetermined time (step 212). When the predetermined time has elapsed, it is determined whether a change has occurred in the output from the output sensor 56 (step 214).

When the pressure sensor 56 functions properly, the output from the sensor does not greatly change during detection of the atmospheric pressure. Accordingly, when it is determined in step 214 that there is a change in the output from the sensor, it can be determined that there is an abnormality in the pressure sensor 56. In this case, it is determined in step 208 that there is an abnormality in the sensor, afterwhich the present process cycle is completed.

Meanwhile, when it is determined in step 214 that there is no change in the output from the sensor, it can be determined that the pressure sensor 56 functions properly. In this case, it is determined that the pressure sensor 56 is in the normal state, afterwhich the present process cycle is completed.

Figure 17:
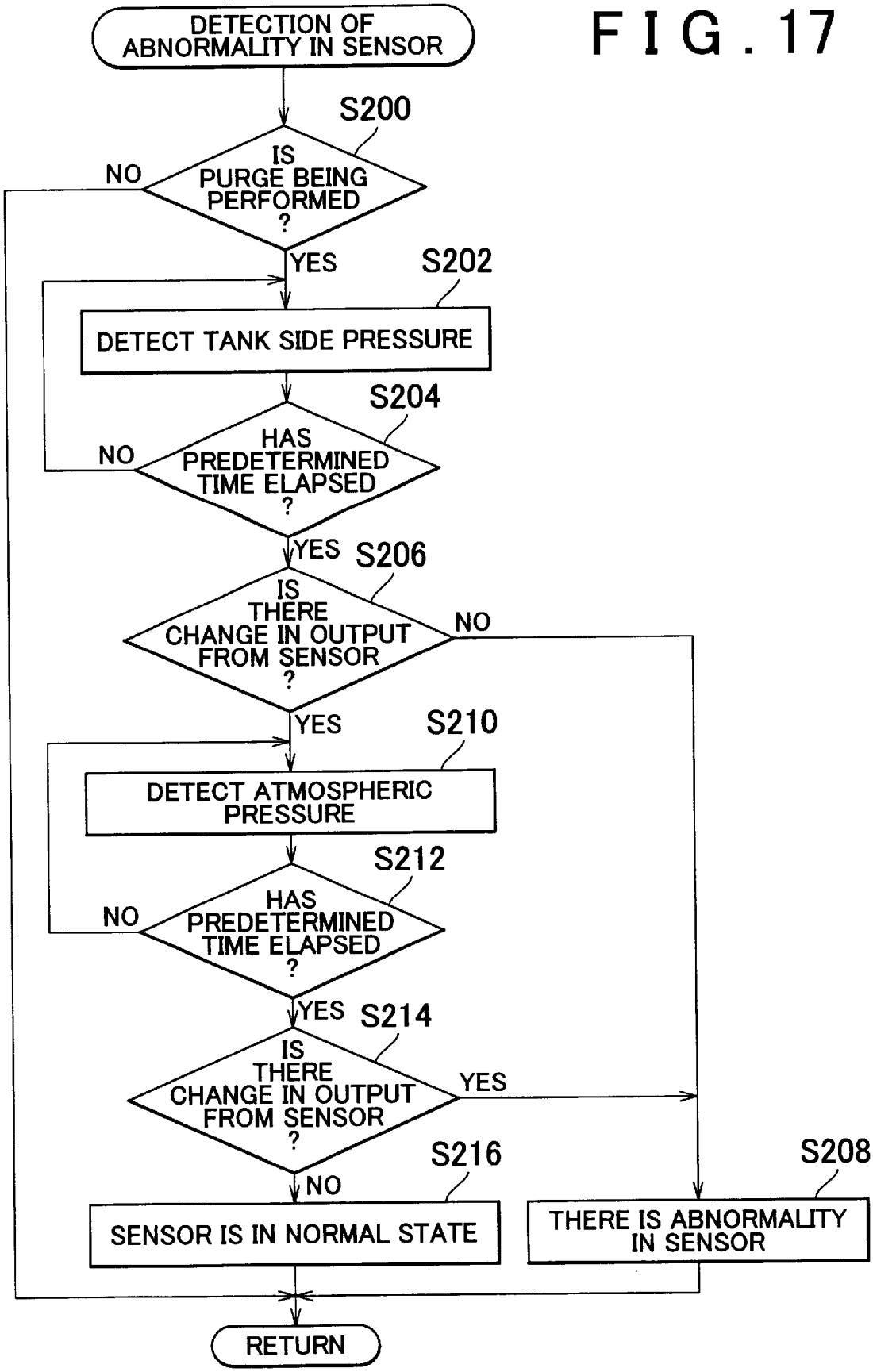
FIG. 17 is a flowchart of a sensor abnormality determination routine performed by the apparatus according to the sixth embodiment.

As described so far, according to the routine shown in FIG. 17, a fluctuating pressure and a non-fluctuating pressure are supplied to the pressure sensor 56 alternately, whereby it can be determined whether an appropriate output can be obtained in each of the states. Then, the apparatus according to the embodiment can accurately perform diagnosis of the state of the pressure sensor 56 based on the result of the determination.

In the routine shown in FIG. 17, the internal pressure in the fuel tank 10 during purge is supplied to the pressure sensor 56 as a fluctuating pressure. However, the pressure is not limited to this. Namely, the fluctuating pressure supplied to the pressure sensor 56 may be a discharge pressure of the booster pump 40.

In the sixth embodiment, a configuration formed by making modifications (1) to (3) to the configuration shown in FIG. 1 is employed. However, the configuration of the apparatus is not limited to this. Namely, the configuration of the evaporative fuel processing apparatus according to the embodiment may be a configuration formed by making modifications (1) to (3) to the configuration shown in FIG. 13 or to the configuration described as a modified example thereof (the configuration in which the CCV 54, the open/close valve or the combination of at least one of them and the positive/negative pressure valve is provided al least one of a position immediately behind the filter 42 and a position in the atmosphere introducing hole 32). Also, the configuration may be a configuration formed by making the modifications (1) to (3) to any one of the configurations shown in the FIGS. 6 to 8.

In the sixth embodiment, "detection pressure switching mechanism" in claim 14 is realized when the ECU 50 performs the processes in steps 190 to 194.

The control system (e.g., the electronic control units 50) of the illustrated exemplary embodiments are implemented as one or more programmed general purpose computers. It will be appreciated by those skilled in the art that the controllers can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the control system. A distributed processing architecture can be used for maximum data/signal processing capability and speed.

While the invention has been described with reference to preferred exemplary embodiments thereof, it is to be understood that the invention is not limited to the disclosed embodiments or constructions. On the contrary, the invention is intended to cover various modifications and equivalent arrangements. In addition, while the various elements of the invention are shown in various combinations and configurations, which are exemplary, other combinations and configurations, including more less or only a single element, are also within the spirit and scope of the invention.

What is claimed is:

1. An evaporative fuel processing apparatus comprising:

a fuel tank;

a canister which communicates with the fuel tank through a vapor passage;

a purge passage which allows an intake passage of an internal combustion engine and the canister to communicate with each other;

an open/close valve which opens or closes the vapor passage;

an isolated state switching mechanism which makes the canister open to an atmosphere or isolates the canister from the atmosphere;

a pressure adjusting mechanism which increases or decreases a pressure in the canister;

a purge control valve which opens or closes the purge passage; and a control system which controls the open/close valve, the isolated state switching mechanism, the pressure adjusting mechanism and the purge control valve.

2. The evaporative fuel processing apparatus according to claim 1, wherein the control system closes a canister space which includes the canister and does not include the fuel tank by closing the open/close valve, isolating the canister from the atmosphere using the isolated state switching mechanism, and closing the purge control valve;

adjusts an internal pressure in the closed canister space using the pressure adjusting mechanism; and performs a diagnosis on leakage in the canister space based on the adjusted internal pressure in the canister space.

3. The evaporative fuel processing apparatus according to claim 2, wherein, the control system prohibits opening of the open/close valve when it is determined that there is leakage in the canister space.

4. The evaporative fuel processing apparatus according to claim 2, wherein the control system closes an entire space including both of the canister and the fuel tank as a single space by opening the open/close valve, isolating the canister from the atmosphere using the isolated state switching mechanism, and closing the purge control valve, when it is determined that there is no leakage in the canister space;

adjusts an internal pressure in the closed entire space using the pressure adjusting mechanism; and performs a diagnosis on leakage in the entire space based on the adjusted internal pressure in the entire space.

5. The evaporative fuel processing apparatus according to claim 2, wherein the control system closes an entire space including both of the canister and the fuel tank as a single space by opening the open/close valve, isolating the canister from the atmosphere using the isolated state switching mechanism, and closing the purge control valve after a completion of a leakage diagnosis for the canister space;

adjusts an internal pressure in the closed entire space using the pressure adjusting mechanism; and performs a diagnosis on leakage in the entire space based on the adjusted internal pressure in the entire space.

6. The evaporative fuel processing apparatus according to claim 5, wherein the control system stores a pressure which the internal pressure in the canister space has reached in a process of a leakage diagnosis as an abnormal time pressure when it is determined that there is leakage in the canister space; and sets a reference value used in a leakage diagnosis for the entire space based on the abnormal time pressure, and performs a leakage diagnosis for the entire space based on the set reference value when it is determined that there is leakage in the canister space.

7. The evaporative fuel processing apparatus according to claim 1, wherein the control system detects an internal pressure in the fuel tank when the open/close valve is kept closed; and performs a leakage diagnosis for the fuel tank based on the closed time tank internal pressure.

8. The evaporative fuel processing apparatus according to claim 1, wherein the control system closes the open/close valve when an internal combustion engine is stopped;

openes the open/close valve when it becomes necessary to allow the fuel tank and the canister to communicate with each other while the internal combustion engine is stopped; and closes the open/close valve when it becomes unnecessary to allow the fuel tank and the canister to communicate with each other while the internal combustion engine is stopped, after the open/close valve is opened.

9. The evaporative fuel processing apparatus according to claim 8, wherein when it becomes necessary to allow the fuel tank and the canister to communicate with each other is when the leakage diagnosis is performed.

10. The evaporative fuel processing apparatus according to claim 1, wherein the control system allows purge gas to flow from the canister to the intake passage by making the canister open to the atmosphere using the isolated state switching mechanism, and opening the purge control valve during operation of an internal combustion engine;

detects concentration of the purge gas while the purge gas flows; and allows the purge gas to flow while the open/close valve is kept closed, and detects concentration of purge gas generated at this time as closed time concentration.

11. The evaporative fuel processing apparatus according to claim 1, wherein, the control system allows purge gas to flow from the canister to the intake passage by making the canister open to the atmosphere using the isolated state switching mechanism, and opening the purge control valve during operation of an internal combustion engine;

detects concentration of the purge gas while the purge gas flows; and maintains the open/close valve in a closed state while the concentration of the purge gas is equal to or higher than predetermined concentration.

12. The evaporative fuel processing means according to claim 1, wherein the control system controls the isolated state switching mechanism such that the canister is isolated from the atmosphere when an internal pressure in the canister exceeds a predetermined reference value which is higher than the atmospheric pressure.

13. The evaporative fuel processing apparatus according to claim 12, wherein the control system controls the isolated state switching mechanism such the canister is isolated from the atmosphere after the internal pressure in the canister is increased by the pressure adjusting mechanism at least until the internal pressure decreases to a value equal to or lower than the predetermined reference value.

14. The evaporative fuel processing apparatus according to claim 1, wherein the control system includes a pressure sensor capable of selectively measuring an internal pressure in the canister which is made to be open to the atmosphere by the isolated state switching mechanism and an internal pressure in the canister which is isolated from the atmosphere by the isolated state switching mechanism.

15. The evaporative fuel processing apparatus according to claim 14, wherein the control system includes detection pressure switching mechanism for selectively introducing the internal pressure in the canister and an internal pressure in the fuel tank to a space whose pressure is detected by the pressure sensor.

16. The evaporative fuel processing apparatus according to claim 14, wherein the control system forms a first state in which an atmospheric pressure is introduced to a space whose pressure is detected by the pressure sensor;

forms a second state in which a fluctuating pressure is introduced to the space whose pressure is detected by the pressure sensor; and determines that the pressure sensor is in a normal state when a change in an output from the pressure sensor in the first state is smaller than a first reference value and a change in an output from the pressure sensor in the second state is larger than a second reference value.

17. A control method of an evaporative fuel processing apparatus comprising a fuel tank, a canister which communicates with the fuel tank through a vapor passage, a purge passage which allows an intake passage of an internal combustion engine and the canister to communicate with each other, an isolated state switching mechanism which makes the canister open to an atmosphere or which isolates the canister from the atmosphere, and a purge control valve which opens or closes the purge passage, comprising the steps of:

closing the canister space which includes the canister and which does not include the fuel tank by closing an open/close valve provided in the vapor passage, isolating the canister from the atmosphere using the isolated state switching mechanism, and closing the purge control valve;

adjusting an internal pressure in the closed canister space to increase or decrease; and performing a leakage diagnosis based on the internal pressure in the canister space adjusted by the canister space internal pressure adjusting mechanism.

18. The evaporative fuel processing method according to claim 17, further comprising by further comprising the step of:

prohibiting opening of the open/close valve when it is determined that there is leakage in the canister space.

19. The evaporative fuel processing method according to claim 17, characterized by further comprising the steps of closing an entire space including both of the canister and the fuel tank as a single space by opening the open/close valve, isolating the canister from the atmosphere using the isolated state switching mechanism, and closing the purge control valve, when it is determined that there is no leakage in the canister space;

adjusting an internal pressure in the closed entire space to increase or decrease; and performing a diagnosis on leakage in the entire space based on the adjusted internal pressure in the entire space.

20. The evaporative fuel processing method according to claim 17, characterized by further comprising the steps of:

closing an entire space including both of the canister and the fuel tank as a single space by opening the open/close valve, isolating the canister from the atmosphere using the isolated state switching mechanism, and closing the purge control valve after a completion of a leakage diagnosis for the canister space;

adjusting an internal pressure in the closed entire space to increase or decrease; and performing a diagnosis on leakage in the entire space based on the adjusted internal pressure in the entire space.

* * * * *